US005755129A

United States Patent [19]

Yamasaki

[11] Patent Number: 5,755,129

[45] Date of Patent: May 26, 1998

[54] PRESS-FORMING METHOD OF A SHEET AND APPARATUS THEREFOR

[75] Inventor: Yuji Yamasaki, Tokyo, Japan

[73] Assignee: NKK Corporation, Tokyo, Japan

[21] Appl. No.: 643,027

[22] Filed: May 2, 1996

[30] Foreign Application Priority Data

May 10, 1995 [JP] Japan ..... 7-111869
May 22, 1995 [JP] Japan ..... 7-122772

[51] Int. Cl.[6] ..... B21D 22/22; B21D 26/02

[52] U.S. Cl. ..... 72/57; 72/350

[58] Field of Search ..... 72/54, 57, 60, 72/350

[56] References Cited

U.S. PATENT DOCUMENTS

| | | | |
|---|---|---|---|
| 2,821,156 | 1/1958 | Lyons . | |
| 3,756,051 | 9/1973 | Rebsamen et al. . | |
| 4,361,020 | 11/1982 | Hirota et al. | 72/57 |
| 4,472,955 | 9/1984 | Nakamura et al. | 72/57 |
| 5,159,826 | 11/1992 | Miyazawa et al. . | |

FOREIGN PATENT DOCUMENTS

| | | | |
|---|---|---|---|
| 2194499 | 3/1974 | France . | |
| 2261955 | 6/1974 | Germany | 72/57 |
| 148027 | 9/1983 | Japan | 72/350 |
| 234624 | 10/1987 | Japan | 72/57 |
| 63-108928 | 5/1988 | Japan . | |
| 2020624 | 1/1990 | Japan | 72/57 |
| 1391772 | 4/1988 | U.S.S.R. | 72/57 |

*Primary Examiner*—David Jones
*Attorney, Agent, or Firm*—Frishauf, Holtz, Goodman, Langer & Chick

[57] ABSTRACT

A sheet pressing method and apparatus using a die and a punch. The invention encompasses holding a sheet between the die and a blank holder to form a first contact surface between the die and the sheet and a second contact surface between the sheet and the blank holder; forming a third contact surface between the punch and the sheet; supplying a pressurized liquid to at least one contact surface; and pressing the sheet through the die with an aid of the punch.

21 Claims, 19 Drawing Sheets

REMARKS

* MARK: A MEANS WRINKLE.
B MEANS FRACTURE.
C MEANS PROCESSING FLAW.

** MARK: ▨ MEANS DEFECT OCCURRENCE.
▭ MEANS GOOD CONDITION.

REMARK: "t" MEANS MAX. SHEET THICKNESS POINT.

REMARKS

* MARK: A MEANS WRINKLE.
B MEANS FRACTURE.
C MEANS PROCESSING FLAW.

** MARK: ▨ MEANS DEFECT OCCURRENCE.
□ MEANS GOOD CONDITION.

REMARKS

* MARK: A MEANS WRINKLE.
B MEANS FRACTURE.
C MEANS PROCESSING FLAW.

** MARK: ▨ MEANS DEFECT OCCURRENCE.
▭ MEANS GOOD CONDITION.

"t" MEANS MAX. SHEET THICKNESS POINT.

"t" MEANS MAX. SHEET THICKNESS POINT.

PRESS-FORMING METHOD OF A SHEET AND APPARATUS THEREFOR

BACKGROUND OF THE INVENTION

1. Field of the Invention

The present invention relates to a method for press-forming a sheet and an apparatus therefor, and more particularly to a method for drawing, stretching and bending, and an apparatus therefor.

2. Description of the Related Art

Press-forming is frequently applied to a conventional sheet forming process, and is widely used for small formed-products such as automobile parts and containers, and also for large formed-products such as automobile external body sheets, sink tables, and bath tubs.

FIG. 18 shows a conventional press-forming method. The reference numeral 1 denotes a punch, 2 denotes a die, 3 denotes a blank holder, and 4 denotes a sheet to be formed. The punch 1, the die 2 and the blank holder 3 are hereinafter collectively referred to simply as "a mold". Press-forming is conducted by pressing down the punch 1 under a condition that the sheet 4 is clamped between the die 2 and the blank holder 3 applying a specified force. During the press-forming process, the problem of generation of wrinkles on and fracture of the sheet often arises.

Defective wrinkles appear at the deep drawing portion. An effective countermeasure to the generation of wrinkles is to hold the sheet 4 to be formed between the die 2 and the blank holder 3 at a high clamping force at a flange section of the deep drawing portion. Increasing of clamping force, however, unavoidably increases friction between the die and the blank holder, which in turn interferes with the smooth flow of the sheet from a gap between the die and the blank holder and finally results in the fracture of the sheet.

Fracture occurs on a deep-drawing section and a stretch forming section. At the deep drawing section, reduction of friction between the sheet 4 and the die 2 and between the sheet 4 and the blank holder 3 allows to make the flow of the sheet between them easy. At the stretch forming section, reduction of friction between the sheet 4 and the punch 1 is effective to make the flow of the sheet from the punch bottom easy.

Application of a highly lubricating press-forming oil is a method to reduce the friction between the sheet and the mold. When the friction between the sheet and the mold is reduced by applying lubricating press-forming oil, for example, the fracture is effectively prevented, but wrinkles are still likely to appear.

Accordingly, with that type of press-forming, it is difficult to avoid both the generation of wrinkles and the generation of fractures at the same time. Particularly for the press-forming to obtain a complex shape product, the easiness of flow of the sheet differs dependent on every part of the sheet to be formed, so the fracture tends to occur at a portion which is difficult to flow and the defective shape such as a wrinkle and deformation likely occurs at a portion which is easy to flow. As a result, the prior art is struggling for the prevention of these defects.

Particularly for the application of highly lubricating press-forming oil, a step of applying oil is added. In addition, that type of oil is often difficult to be removed by washing, and degreasing becomes difficult.

SUMMARY OF THE INVENTION

It is an object of the present invention to provide a method and an apparatus wherein generation of the fracture and the wrinkle can be avoided.

To attain the object, the present invention provides a press-forming method of a sheet using a die and a punch, the method comprising the steps of:

(a) holding a sheet between the die and a blank holder to form a first contact surface between the die and the sheet and a second contact surface between the sheet and the blank holder;

(b) forming a third contact surface between the punch and the sheet;

(c) supplying a pressurized liquid to at least one contact surface selected from the group consisting of the first contact surface, the second contact surface and the third contact surface; and (d) pressing the sheet through the die with the aid of the punch.

In the step (c) of supplying the pressurized liquid, the pressurized liquid can be supplied only to the first contact surface between the die and the sheet. The pressurized liquid can be supplied only to the second contact surface between the sheet and the blank holder. The pressurized liquid can be supplied only to the third contact surface between the sheet and the punch. The pressurized liquid can be supplied to the first contact surface and the second contact surface. The pressurized liquid can be supplied to the first contact surface, second contact surface and the third contact surface. The pressurized liquid has preferably a pressure higher than any one contact pressure existing in respective contact surfaces.

In the step (c) of supplying the pressurized liquid, it is preferable that the pressurized liquid is discharged from at least one discharge opening which faces at least one contact surface and is introducd into at least one liquid pool which is arranged around at least one discharge opening. Said at least one discharge opening can be arranged in the die, the blank holder or the punch. Said at least one liquid pool can be arranged around the discharge opening in the die, the blank holder or the punch.

When the liquid pool is arranged around the discharge opening in the die, the liquid pool is preferably arranged in a position corresponding to a possible-fracture-zone at a flange of a product. The liquid pool has a depth more preferably so that the possible-fracture-zone does not contact the die.

When the liquid pool is arranged around the discharge opening in the die, the liquid pool can be arranged in a position corresponding to a sheet-thickness-increasing-zone at the flange of the product. It is preferable that the liquid pool has a depth so that the sheet-thickness-increasing-zone does not contact the die. Also, it is desirable that the liquid pool has a contour of a constant-sheet-thickness line and has a depth of {(maximum sheet thickness) minus (sheet thickness of constant thickness curve zone)} or more.

When the liquid pool is arranged around the discharge opening in the blank holder, the liquid pool is preferably arranged in a position corresponding to a possible-fracture-zone at a flange of a product. It is more preferable that the liquid pool has a depth so that the possible-fracture-zone does not contact the blank holder.

When the liquid pool is arranged around the discharge opening in the blank holder, the liquid pool is preferably arranged in a position corresponding to a sheet-thickness-increasing-zone at the flange of the product. It is preferable that the liquid pool has a depth so that the sheet-thickness-increasing-zone does not contact the die. Also, it is desirable that the liquid pool has a contour of a constant-sheet-thickness line and has a depth of {(maximum sheet thickness) minus (sheet thickness of constant thickness curve zone)} or more.

Furthermore, the present invention provides a press-forming apparatus comprising:

(a) press means for pressing a sheet, comprising a die and a punch;

(b) a blank holder for holding the sheet;

(c) liquid supply means for supplying a pressurized liquid into at least one contact surface selected from the group consisting of a first contact surface between the die and the sheet, a second contact surface between the sheet and the blank holder and a third contact surface between the punch and the sheet.

The liquid supply means comprises a pressure device for pressurizing a liquid into the pressurized liquid, a liquid supply path which introduces the pressurized liquid into the first contact surface and which is arranged in the die, a discharge opening of the liquid supply path which faces the first contact surface, and a liquid pool which is arranged around the discharge opening.

The liquid supply means comprises a pressure device for pressurizing a liquid into the pressurized liquid, a liquid supply path which introduces the pressurized liquid into the second contact surface and which is arranged in the blank holder, a discharge opening of the liquid supply path which faces the second contact surface, and a liquid pool which is arranged around the discharge opening.

The liquid supply means comprises a pressure device for pressurizing a liquid into the pressurized liquid, a liquid supply path which introduces the pressurized liquid into the third contact surface and which is arranged in the punch, a discharge opening of the liquid supply path which faces the third contact surface, and a liquid pool which is arranged around the discharge opening.

DESCRIPTION OF THE EMBODIMENT

In the present embodiment, liquid pools are arranged at a die and a blank holder. A sheet to be press-formed is clamped between the die and the blank holder. A pressurized liquid is introduced through dischage openings into two contact surfaces, that is, a first contact surface between the sheet and the die, and a second contact surface between the sheet and blank holder respectively. Press-forming is performed while introducing the pressurized liquid. In the case that the press-forming is carried out according to the present embodiment, since the pressurized liquid exists in the respective contact surfaces, friction force of the first contact surface between the sheet and the die and friction force of the second contact surface between the sheet and the blank holder are reduced remarkably. Occurrence of the fracture can be avoided.

Generation of wrinkle is prevented as follows.

Since the pressurized liquid is introduced into the sheet surfaces from both the discharge openings of the die and the discharge openings of the blank holder, the sheet to be press-formed is pressed uniformly to both the die and the blank holder. The press-forming is carried out while being pressed uniformly to both the die and the blank holder. Irregularities to cause the wrinkle is removed to increase a blank-holder force substantially. Comparing to a case that the sheet is clamped between the die and the blank holder without introducing the pressurized liquid, the present embodiment prevents the wrinkle from generating.

In the above embodiment, though the discharge openings are arranged at both the die and the blank holder, the configuration is not always limited to it. The discharge opening can be arranged only at the die or the blank holder.

Furthermore, in the present invention, the discharge opening can be arranged at the punch and pressurized liquid can be introduced to the contact surface between the punch and the sheet. Since the pressurized liquid exists in the contact surface between the punch and the sheet, friction force of the contact surface between the sheet and the punch is reduced remarkably. Generation of strain is promoted at the contact part of the punch to the sheet. Through a boundary between a contact part of punch and a non-contact part of the punch is a possible-fracture-zone, the promotion of the strain generation prevents the strain from concentrating at the possible-fracture zone and the fracture can be avoided.

Figure 1:
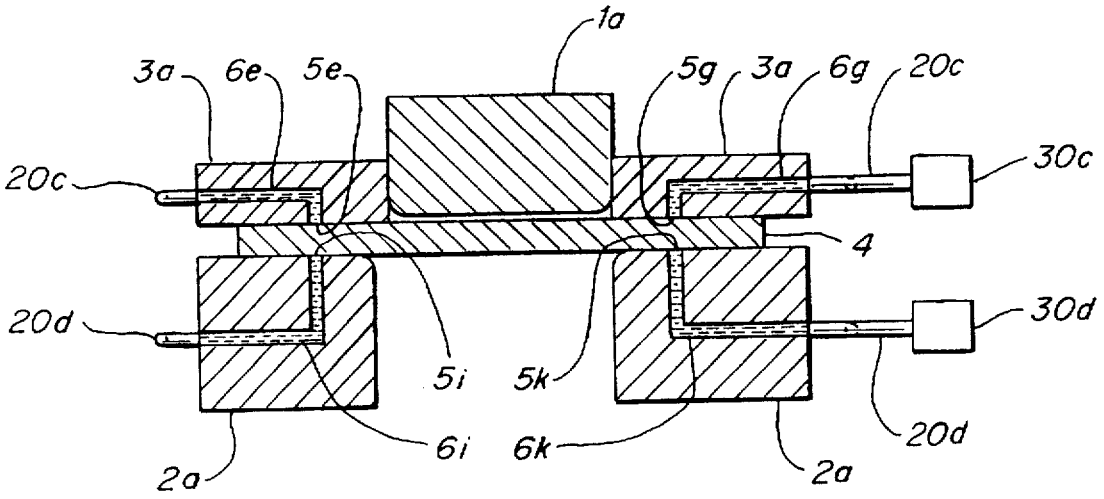
FIG. 1 is a view of a press-forming method using liquid discharge openings which are arranged in a die and a blank holder according to the present invention.

FIG. 1 shows a press-forming method using discharge openings arranged in the die and the blank holder. The discharge openings 5 are arranged at both the die 2 and the blank holder 3. Liquid is pressurized by pumps 30 to introduce to the discharge openings 5 through liquid supply pipes 20 and liquid supply paths 6. The press-forming is performed while introducing the pressurized liquid into the first contact surface between the die 2 and the sheet 4, and the second contact surface between the blank holder 3 and the sheet 4, from the discharge openings 5.

Figure 2:
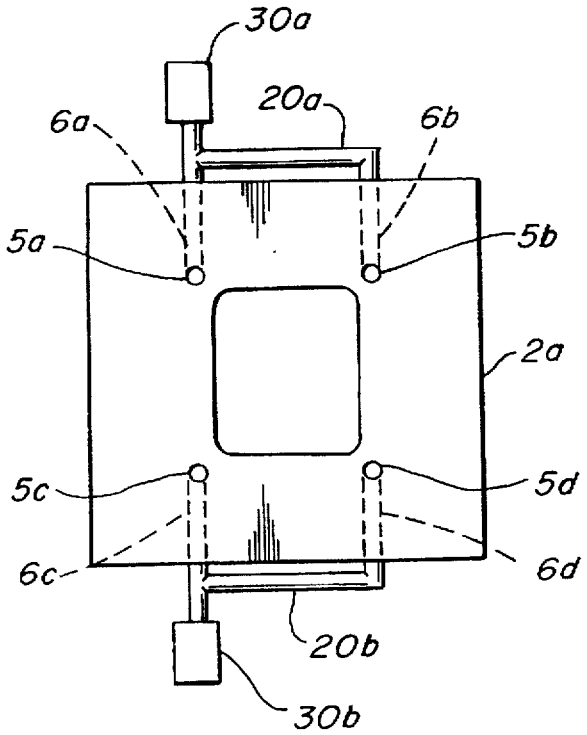
FIG. 2 is a plan view of supplying of pressurized liquid into the die in the present invention.

FIG. 2 is a plan view which shows the supplying of the pressurized liquid into the die. The liquid is pressurized by the pump 30*a*. The pressurized liquid is introduced into the discharge openings 5*a*, 5*b* through the liquid supply pipe 20*a* and liquid supply paths 6*a*, 6*b*. In the same manner, the liquid is pressurized by the pump 30*b*. The pressurized liquid is introduced into the discharge openings 5*c*, 5*d* through the liquid supply pipe 20*b* and the liquid supply paths 6*c*, 6*d*.

Figure 3:
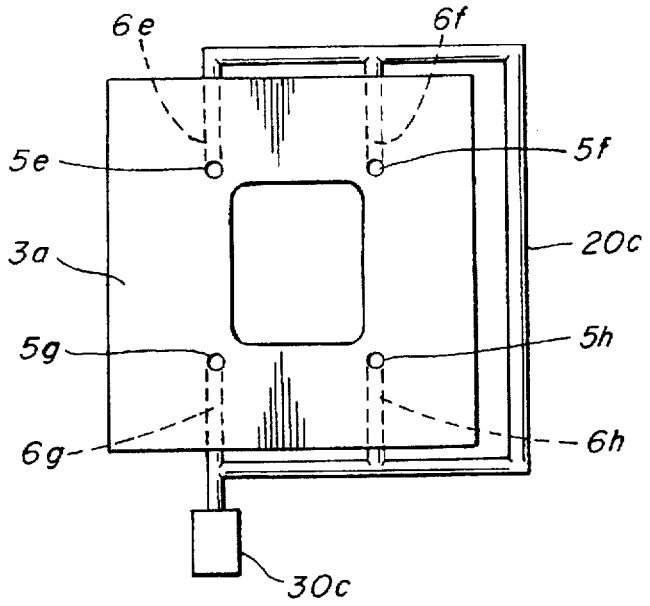
FIG. 3 is a plan view of supplying of the pressurized liquid into the blank holder in the present invention.

FIG. 3 is a plan view which shows the supplying of the pressurized liquid into the blank holder. The liquid is pressurized by the pumps 30*c*. The pressurized liquid is introduced into the discharge openings 5*e*, 5*f*, 5*g*, 5*h* through the liquid supply pipes 20*c* and liquid supply paths 6*e*, 6*f*, 6*g*, 6*h*.

Figure 4:
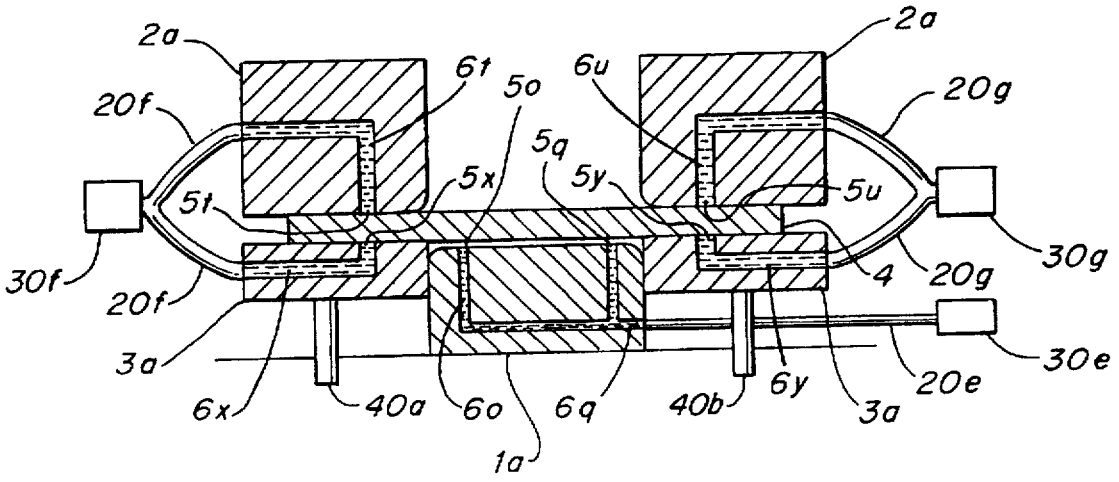
FIG. 4 is a view of a press-forming method using liquid discharge openings which are arranged in the punch, the die and the blank holder in the present invention.

FIG. 4 shows a press-forming method wherein the liquid openings are arranged at the punch, the die and the blank holder. The press-forming is performed while introducing the pressurized liquid into the contact surface between the punch 1 and the sheet 4 from the discharge openings 5. The reference numeral 40 is a die cuhshon pin.

Figure 5:
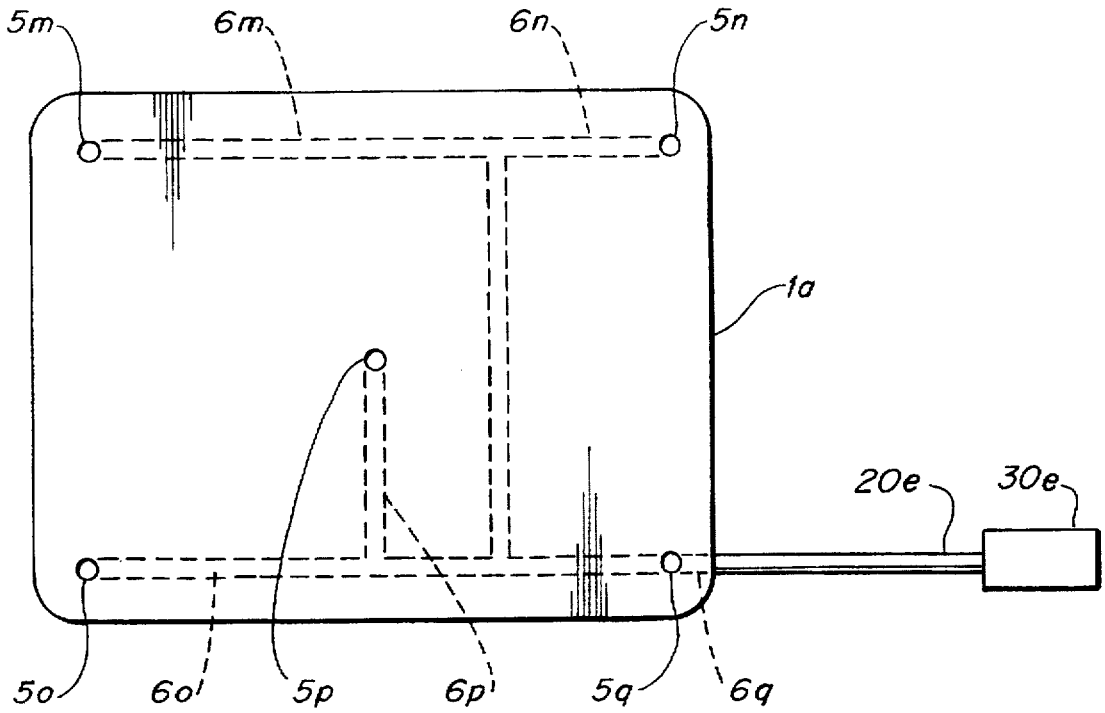
FIG. 5 is a plan view of supplying of the pressurized liquid into the punch in the present invention.

FIG. 5 is a plan view which shows the supplying of the pressurized liquid into the punch. The liquid pressurized by the pump 30 is introduced into the five discharge openings 5 through the liquid supply pipe 20 and the liquid supply hole 6.

PREFERRED EMBODIMENT 1

According to the embodiment 1, the pressurized liquid is introduced into the surface of the sheet from a plurality of discharge openings arranged on at least one of the die, the blank holder, and the punch at a pressure more than the contact pressure between the sheet and the die, the blank holder, or the punch. Accordingly, even when the liquid flows out in a low pressure stage from the lowest contact pressure section, the pressure of the pressurized liquid at the other discharge openings is not disturbed. Consequently, the pressurized liquid flows out from all the discharge openings, and perfect lubrication is sustained. As a result, generation of fracture and wrinkle is avoided.

Regarding the deep drawing process, in the forming of any shape of product, the supply of the pressurized liquid is possible to plurality of contact portions between the sheet and the mold at a pressure more than the contact pressure. Accordingly, pressurized liquid is continuously supplied to significantly reduce friction between the sheet and the blank holder or between the sheet and the punch, thus avoiding the generation of the fracture.

As for the stretch-forming process, the press-forming is conducted while supplying the pressurized liquid from the discharge opening on the punch at a pressure more than the contact pressure at the contact portions between the punch and the sheet. Accordingly, the pressurized liquid is continuously supplied to reduce the friction between the punch and the sheet. Thus, the portion of the sheet positioned at the punch bottom in the initial period of forming flows through a punch shoulder to a punch wall during the forming stage. As a result, the flow of the sheet becomes uniform over the whole punch area, and the strain at the punch wall reduces, thus the generation of fracture is avoided.

For the suppression of the wrinkle generation, the press-forming is conducted while supplying the pressurized liquid against the plurality of wrinkle generation sections on the flange portion at a pressure overriding the contact pressure. Accordingly, the pressurized liquid is continuously supplied to assure the progress of forming while the sheet at the wrinkle-generation sections receive uniform face pressure between the sheet and the die or the blank holder or between the die and the blank holder, thus avoiding the generation of the wrinkle.

Following is the reason why the liquid pool which is connected with the discharge opening is located on the die and/or the blank holder at the position corresponding to the possible fracture portion at the flange portion.

When deep drawing is conducted using the apparatus of the embodiment-1, the friction between the sheet and the die or between the sheet and the blank holder significantly reduces, and the generation of the fracture is avoided owing to the presence of pressurized liquid at the possible fracture portion throughout the drawing process.

The liquid pool can be arranged corresponding to a non-uniform increase in sheet thickness at the flange portion of formed product generated during the deep drawing. Since the pressurized liquid exists between the sheet and the die or between the sheet and the blank holder throughout the drawing process, the friction between the sheet and the die or between the sheet and the blank holder is significantly reduced, thus the generation of the fracture is avoided.

As for the suppression of wrinkle, since the pressurized liquid is supplied from the liquid pool arranged on the die and/or the blank holder against the sheet, the presence of the pressurized liquid is secured throughout the drawing process in any shape.

As a result, the forming process proceeds while the uniform face pressure is received on at least one surface of the sheet. The function increases substantial blank holder pressing force to drastically avoid the generation of the wrinkle compared with the conventional case that the sheet is simply clamped by the die and the blank holder.

The basic concept of the embodiment-1 is to conduct press-forming while supplying the pressurized liquid against the sheet from at least one of the die, the blank holder, and the punch at a pressure overriding the contact pressure between the sheet and the die, the blank holder, or the punch having the liquid discharge opening. The effect of the embodiment-1 is also attained by applying separately to the die, the blank holder, and the punch. For severer press-forming process, the pressurized liquid is supplied from all of the punch, the die, and the blank holder.

For conducting press-forming while taking care of investment cost, production cost, and effect of the forming process, it is effective to apply the embodiment-1 to the die and/or the blank holder at the deep drawing section in the press-forming in which the deep drawing is dominant, or in the press-forming of complex shape.

For the stretch-forming section in press-forming in which the stretch-forming is dominant, or in press-forming of complex shape, it is effective to apply the embodiment-1 to the punch.

In the press-forming process with the supply of the pressurized liquid, the supply of the pressurized liquid usually begins immediately after clamping the sheet between the die and the blank holder. The supply of pressurized liquid may begin before clamping or immediately before generating the wrinkle and the fracture after progressing the forming to some extent.

Any type of means for supplying the pressurized liquid is applicable if only the means can control the liquid pressure at every discharge opening and control the timing of liquid application. Detail of the mechanism of the means is arbitrary.

The liquid supply means comprises a liquid supply path, a liquid supply pipe, and a pressure-increase means such as a liquid supply pump. A single liquid discharge opening may have a single system of liquid supply path, liquid supply pipe, and liquid supply pump. The embodiment 1 includes the case that the number of liquid discharge opening is one.

Higher pressure application to the liquid is preferred. Generally, a significant effect appears at the pressure of 2 MPa or more for the prevention of the wrinkle generation and of 5 MPa or more for the prevention of the fracture occurrence.

The apparatus may have means for adjusting the liquid pressure response to the easiness of forming and to the generation of defects by selecting appropriately the pump performance, the switching of pipe connection, and/or the pressure regulation valve.

The liquid pressure may be 50 MPa or less depending on the practical strength of the mold, the liquid supply pipe, and the liquid supply pump, or may be set using a relief valve or a pressure regulation valve to protect the apparatus.

The kind of liquid applied in the embodiment 1 is not necessarily limited. Any liquid is applicable so long as it does not induce defects such as corrosion and plugging within the liquid supply route, and it does not induce corrosion of sheet and does not degrade the degreasing property.

Example 1

Example 1 gives a construction of an apparatus for forming a square tube with a bottom using mainly deep drawing, and describes the press-forming of the square tube with a bottom using the apparatus. FIGS. 6 through 9 show the construction of the apparatus. Table 1 shows the condition of pressurizing the liquid. FIG. 10 shows the press condition and the result.

Figure 6:
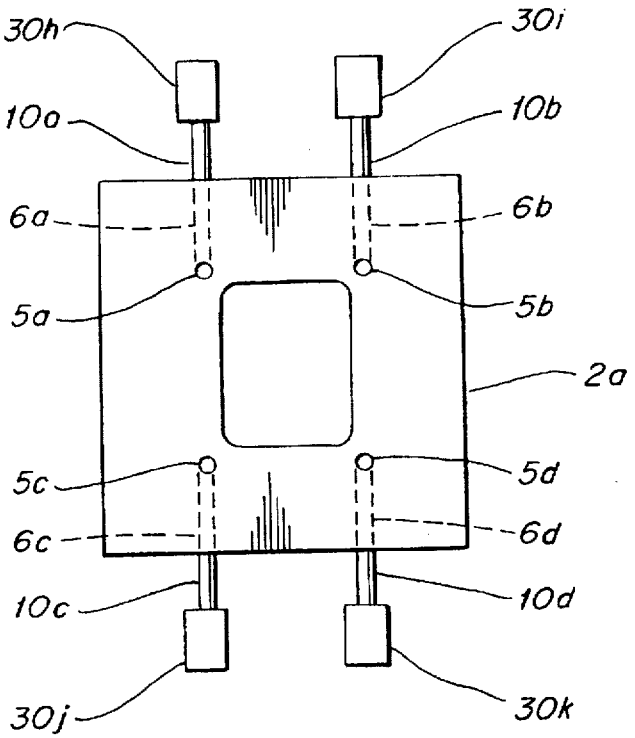
FIG. 6 is a plan view of the die and a liquid charge unit for forming a square tube according to Example 1 of Embodiment-1.
Figure 7:
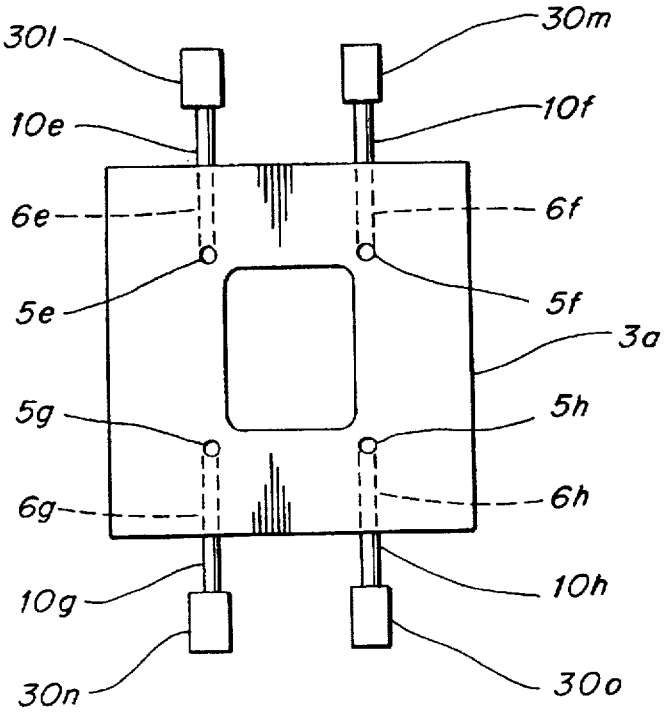
FIG. 7 is a bottom view of the blank holder and the liquid charge unit for forming the square tube according to Example 1 of Embodiment-1.

FIG. 6 is a plan view of the die and the liquid supply unit and their connection. FIG. 7 is a bottom view of the blank holder and the liquid supply unit and their connection. For both figures, each single liquid discharge opening has a separate system of liquid supply path, liquid supply pipe, and liquid supply pump.

In FIGS. 6 and 7, the referential numeral 2*a* denotes a die, 3*a* denotes a blank holder, 5*a* through 5*h* denote liquid discharge openings, 6*a* through 6*h* denote liquid supply paths, 10*a* through 10*h* denote liquid supply pipes, and 30*h* through 30*o* denote liquid supply pumps.

Figure 8:
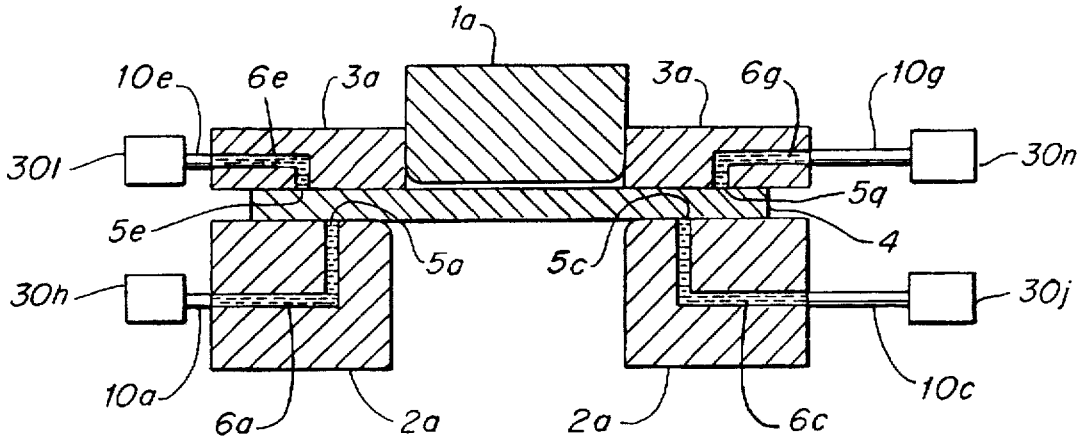
FIG. 8 is a view showing a system of liquid supply means in forming the square tube using a double-action press according to Example 1 of Embodiment-1.

FIG. 8 is a view of a system of liquid supply means for supplying the pressurized liquid using a double-action press. Each single liquid discharge opening has separate system of liquid supply path, liquid supply pipe, and liquid supply pump.

The sheet 4 to be formed is placed on the die 2*a*, and the sheet 4 is clamped using the blank holder 3*a* under pressure, then the drawing is performed by descending the punch 1*a*. During forming process, the pressurized liquid is supplied to the space between the sheet 4 and the die 2*a* and between the sheet 4 and the blank holder 3*a* using the eight liquid supply pumps, 30*h*, 30*i*, 30*j*, 30*k*, 30*l*, 30*m*, 30*n*, and 30*o*, through the eight liquid supply pipes, 10*a*, 10*c*, 10*e*, 10*g*, etc., through the liquid supply paths, 6*a*, 6*c*, 6*e*, 6*g*, etc. on the die 2*a* or on the blank holder 3*a*, and through the liquid discharge openings, 5*a*, 5*c*, 5*g*, etc.

Since each liquid discharge opening 5 has separate single system of liquid supply path 6, liquid supply pipe 10, and liquid supply pump 30, the phenomenon of insufficient increase of liquid pressure owing to the non-uniform contact pressure between the sheet 4 and the mold at different portions can be avoided. The phenomenon results from the unsatisfactory finish of mold, accuracy of the press apparatus, and non-uniform distribution of sheet thickness generated during the forming process. In addition, the suppression of the wrinkle generation and the avoidance of the fracture is achieved without failure.

Figure 9:
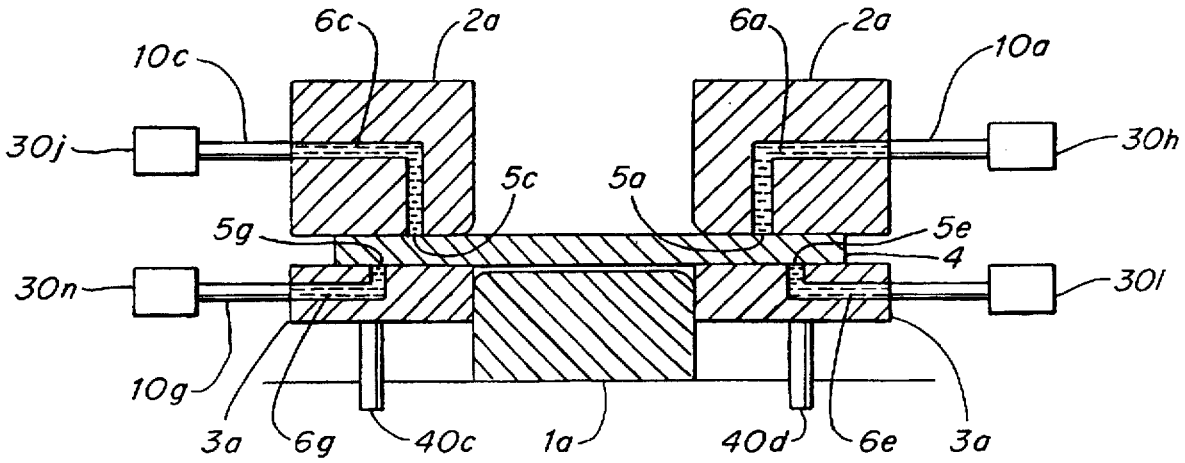
FIG. 9 is a view showing a system of liquid supply means in forming by using a single-action press according to Embodiment-1.
Figure 10:
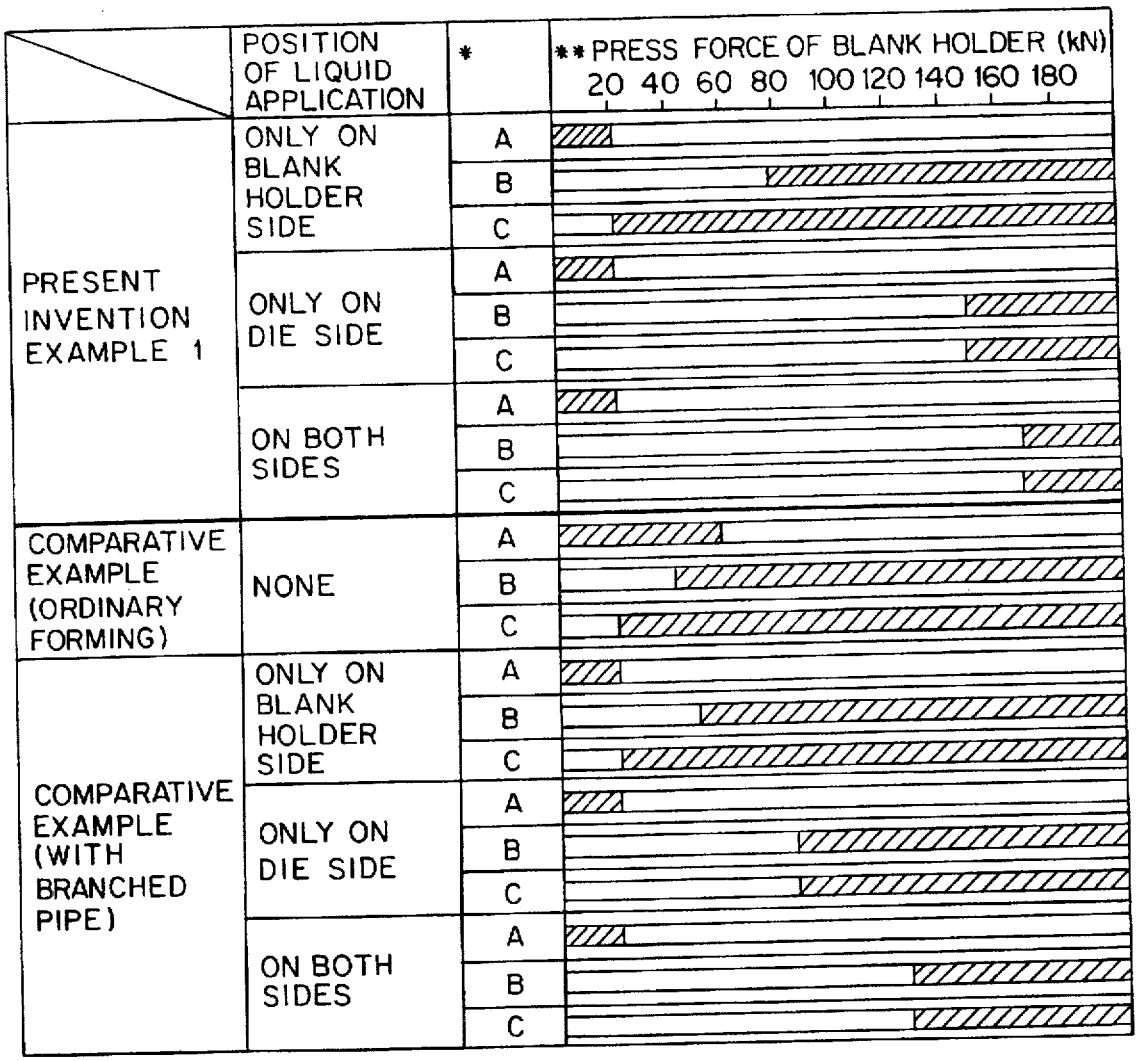
FIG. 10 shows the result of tests for forming the square tube of Example 1, Comparative Example 1 and Comparative Example 2 in Embodiment-1.

FIG. 9 is a view of system of a liquid supply means for supplying the pressurized liquid using a single-action press. Each single liquid discharge opening has a separate system of liquid supply path, liquid supply pipe, and liquid supply pump.

In this manner, the embodiment-1 allows to use any type of a press apparatus so long as it performs deep drawing.

Now application of the embodiment-1 to a cold-rolled steel sheet will be described. It should be noted that the embodiment-1 allows to use any material so long as it is used to deep drawing.

FIG. 10 shows the result of tests for forming square tube with a bottom. The result was obtained using the sheet of JIS SPCE having 0.7 mm of thickness and size of 200 mm×200 mm to form square tube with a bottom having 40 mm of shape height and a size of 100 mm×100 mm under various conditions of liquid supply. The apparatus applied was a combined apparatus of FIGS. 6 through 8 for Example 1, an apparatus of FIG. 1 for Comparative Example 1, and an apparatus of FIG. 18 for Comparative Example 2.

Comparative Example 1 used an apparatus shown in FIG. 1, where the liquid supply was possible to branch from a single system against the four liquid discharge openings 5*e*, 5*g*, 5*i*, and 5*k*.

Figure 18:
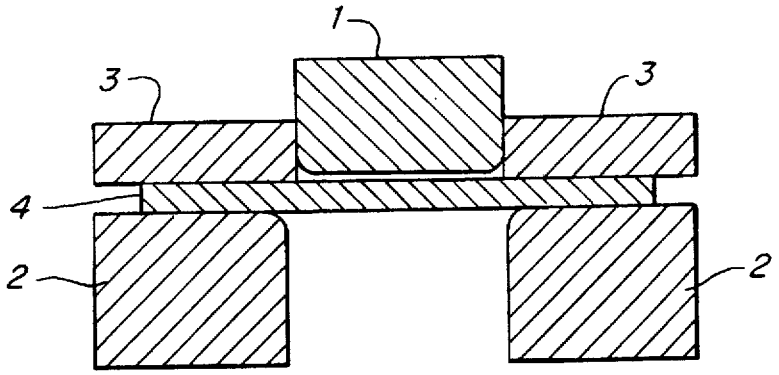
FIG. 18 (PRIOR ART)
FIG. 18 is a cross sectional view of a conventional press-forming.

Comparative Example 2 used an apparatus shown in FIG. 18, under the conventional press-forming condition of square tube with a bottom using a rust-proof oil lubrication.

The relation between the set pressure of the liquid supply and the maximum liquid pressure during press-forming process is shown in Table 1.

TABLE 1

| | Liquid Supply | Set liquid pressure (MPa) | Actual maximum liquid pressure (Mpa) |
|---|---|---|---|
| Example 1 | Blank holder | 25 | 8 to 10 |
| | Die | 25 | 10 to 20 |
| | Blank holder and Die | | |
| | holder | 25 | 8 to 10 |
| | Blank holder side | | |
| | Die side | 25 | 10 to 20 |
| Comparative Example 1 | Blank holder | 25 | 8 |
| | Die | 25 | 10 |
| | Blank holder and Die | | |
| | Blank holder side | 25 | 8 |
| | Die side | 25 | 10 |

In Example 1, actual maximum liquid pressure differs in each of the four liquid supply systems. The difference came from the local difference of the contact pressure between the sheet 4 and the mold 2*a* and 3*a* dependent on the shapes of the formed product.

The reason why the maximum liquid pressure at the blank holder 2*a* was the lowest is that the contact pressure between the blank holder 2*a* and the sheet 4 is less.

On the other hand, Comparative Example 1 gave the maximum liquid pressure corresponding to the lowest value of the maximum liquid pressure in Example 1. This is because the liquid flew out from the liquid discharge opening 5 where the contact pressure between the sheet 4 and the mold 2*a* and 3*a* is lowest.

The evaluation was given on the basis of the wrinkle, fracture, and flaw generated at corner under various levels of pressing-force applied to the blank holder.

In the case of Comparative Example 2, conventional forming generated the wrinkle under a low blank holder pressing-force, and the increase in the pressing-force for avoiding the generation of wrinkle induced the generation of fracture and the occurrence of processing flaw at the drawing wall at corner portion. All of these defects resulted in defective products. That is, the conventional forming method has no processing condition that avoids all of these defects at a time.

In the case that the forming is conducted while supplying the pressurized liquid against the sheet clamped between the die and the blank holder and that the liquid is supplied only from the blank holder, where the liquid is supplied branching from a single system of supply unit in Comparative Example 1, the generation of the wrinkle and fracture was avoided by setting the blank holder pressing-force to a range of from 20 to 50 kN.

On the other hand, in the case that the liquid is supplied only from the blank holder as in Example 1, the blank holder pressing-force was allowed to extend to a range of from 20 to 80 kN to avoid the generation of the wrinkle and fracture, though the occurrence of the processing flaw was remained to a level of Comparative Example 1.

In the case that the liquid is supplied only from the die, Comparative Example 1 provided good products without generating the wrinkle, fracture, and processing flaw on the drawing wall at corner portion at a blank holder pressing-force ranging from 20 to 90 kN.

Example 1 allowed to extend the blank holder pressing-force to a range of from 20 to 150 kN, and provided very good products without generating the wrinkle, fracture, and processing flaw on the drawing wall at corner portion.

In the case that the liquid is supplied from both the die and the blank holder, Comparative Example 1 provided good products without generating the wrinkle, fracture, and processing flaw on the drawing wall at corner portion by setting the blank holder pressing-force ranging from 20 to 125 kN.

Example 1 allowed to extend the blank holder pressing-force to a range of from 20 to 170 kN, and provided very good products without generating the wrinkle, fracture, and processing flaw on the drawing wall at corner portion.

According to the embodiment-1, the presence of pressurized liquid between the sheet and the die or between the die and the blank holder significantly reduces the generation of flaws on the plate such as a surface-treated steel sheet, a precoat sheet, an aluminum alloy sheet, a tin plate which are vulnerable to drawing.

In the case that the surface of the sheet is finished with enriched layer or passive layer, each of which has superior property of corrosion resistance, heat resistance, resistance to emission-to-gas, or beautiful appearance, and that the surface layer is vulnerable to the forming given by the die and the blank holder, a method and an apparatus of the embodiment 1 reduces the damage.

Example 2

Figure 11:
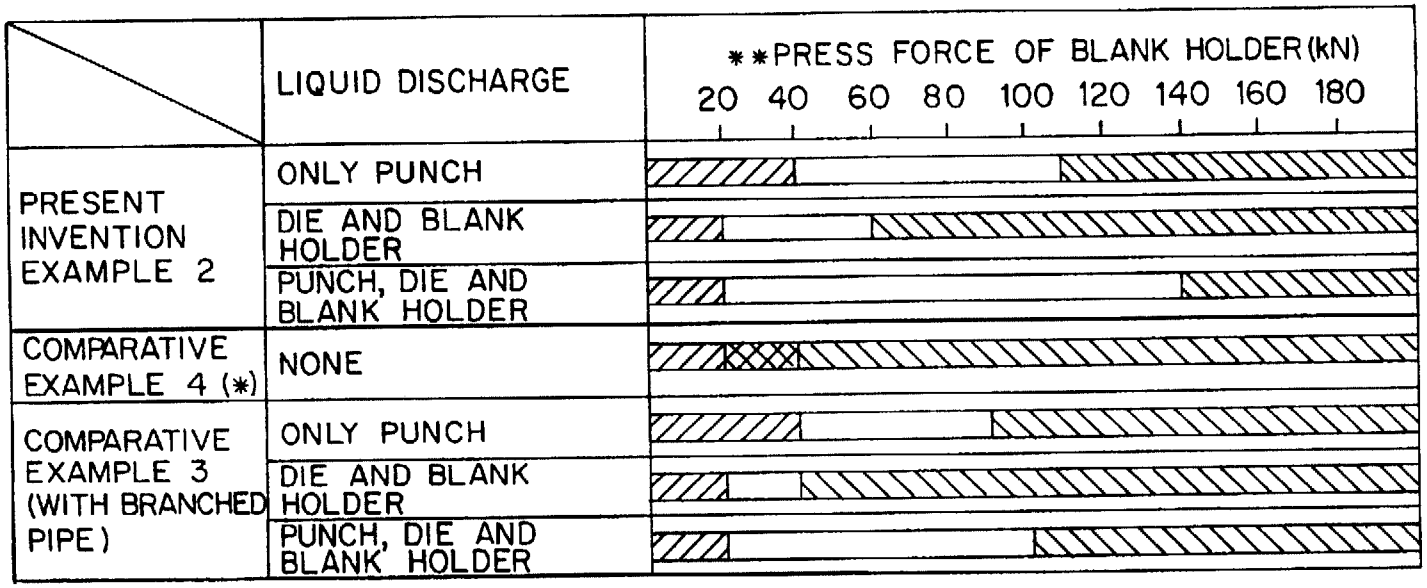
FIG. 11 shows the result of tests for forming the trapezoidal tube of Example 2, Comparative Example 3 and Comparative Example 4 in Embodiment-1.
Figure 12:
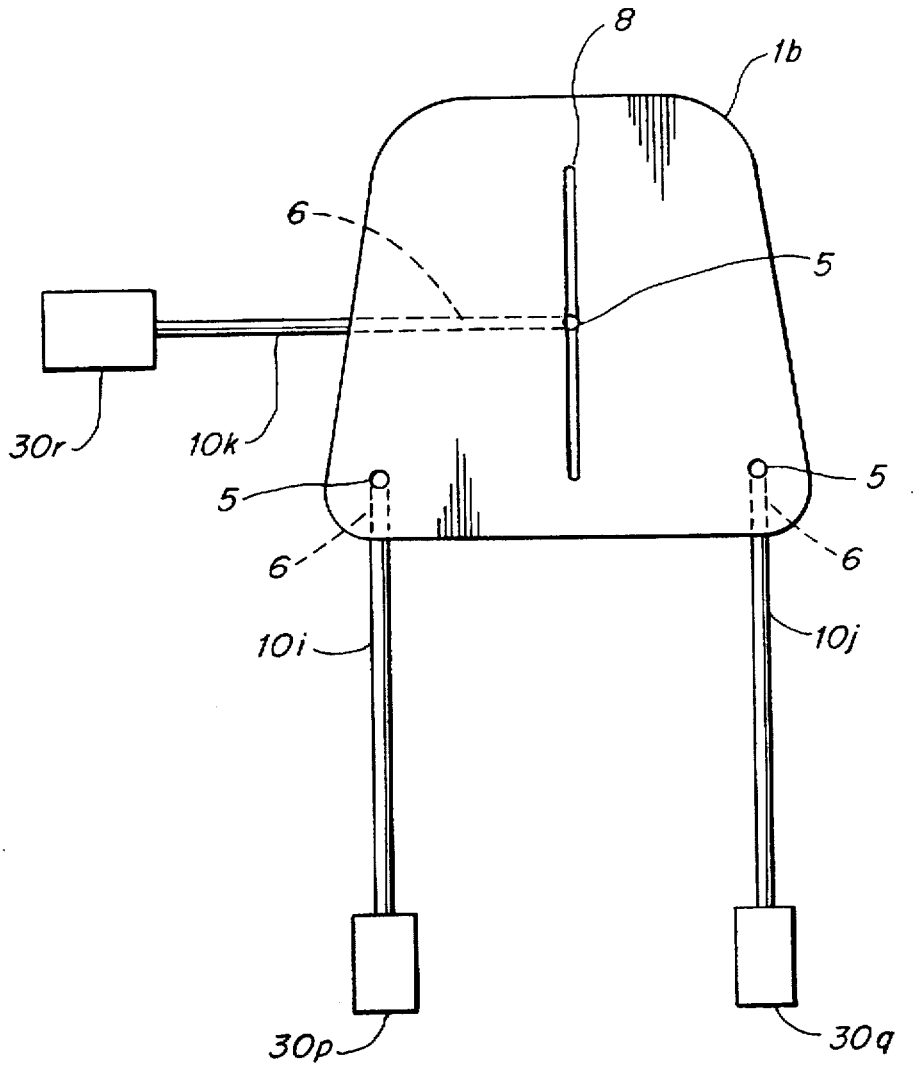
FIG. 12 is a bottom view of the punch and the liquid supply unit for forming a trapezoidal tube in Example 2 of Embodiment 1.
Figure 13:
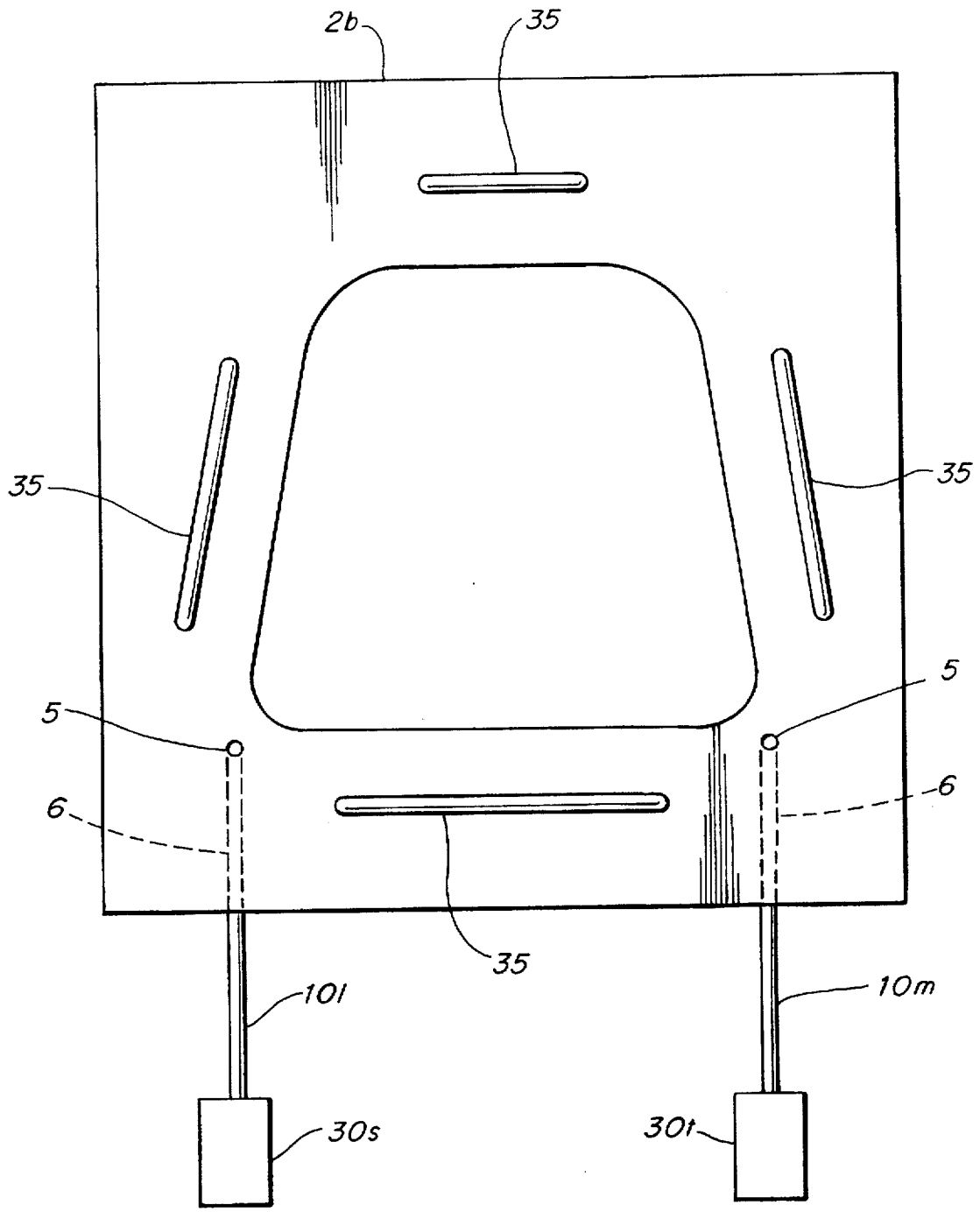
FIG. 13 is a plan view of the die and the liquid supply unit in forming a trapezoidal tube in Example 2 of Embodiment 1.
Figure 14:
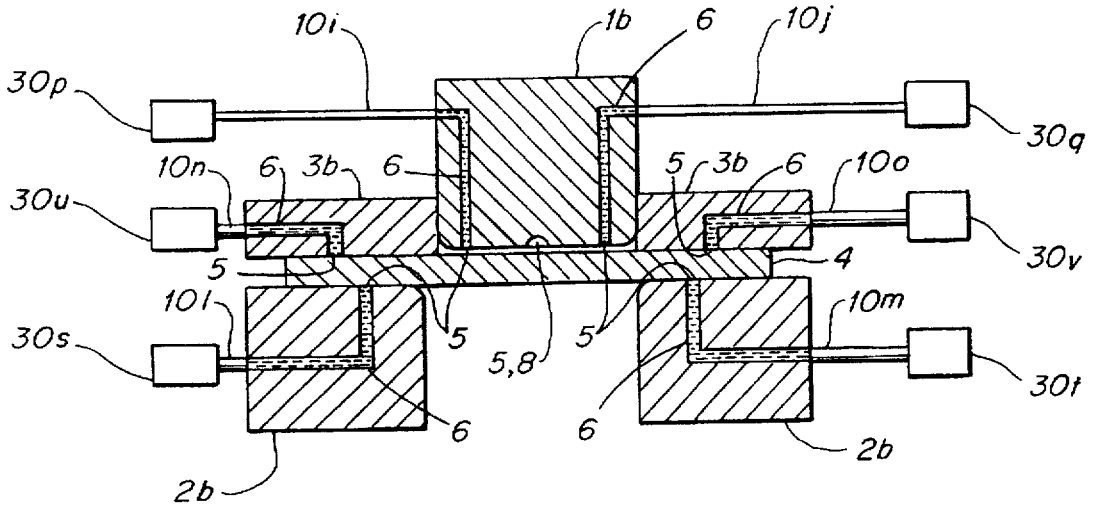
FIG. 14 is a view showing a system of a liquid supply means in stretch-forming using a double-action press in Example 2 of Embodiment 1.

Example 2 of the embodiment-1 gives the construction of an apparatus for forming a trapezoidal tube with a bottom using mainly stretching, and describes the press-forming of the trapezoidal tube with a bottom using the apparatus. FIGS. 12 through 14 show the construction of the apparatus. Table 2 shows the condition of the liquid pressure. FIG. 11 shows the press condition and the result.

FIG. 11 shows the result of tests for forming the trapezoidal tube with a bottom. The result was obtained using the sheet 4 of galvannealed steel sheet having 1.0 mm of thickness to form an isosceles trapezoidal tube with a bottom having 35 mm of shape height and a size of 150 mm of upper base and 170 mm of lower base under various conditions of the liquid supply.

The apparatus applied to the forming test in Example 2 is a double-action press shown in FIG. 14 using the punch 1*b* in FIG. 12, the die 2*b* in FIG. 13.

Comparative Example 3 is the forming of the sheet 4 clamped between the die 2*b* and the blank holder 3*b* while using a single system of liquid supply unit which supplies the liquid to two liquid discharge openings located on the die 2*b* and the blank holder 3*b*, respectively, and while using a single system of the liquid supply unit which supplies the liquid to three liquid discharge openings 5 located on the punch 1*b*.

Comparative Example 4 used an apparatus shown in FIG. 18 to conduct conventional forming using a rust-proof lubricant oil.

FIG. 12 is a bottom view of the punch and the liquid supply unit and their connection. FIG. 13 is a plan view of the die and the liquid supply unit and their connection. The apparatus in both has a separate system of the liquid supply path, the supply pipe, and liquid supply pump for each of the liquid discharge opening.

FIG. 14 is a view of a liquid supply means for supplying the pressurized liquid using a double-action press. Each single liquid discharge opening has separate system of the liquid supply path, liquid supply pipe, and liquid supply pump.

The relation between the set pressure of the liquid supply and the maximum liquid pressure during actual press-forming process is shown in Table 2.

TABLE 2

| | Liquid supply | Set liquid pressure (MPa) | Actual maximum liquid pressure (MPa) |
|---|---|---|---|
| Example 2 | Punch | 25 | 12 to 18 |
| | Die and Blank holder | | |
| | Die side | 25 | 12 to 22 |
| | Blank holder side | 25 | 10 to 12 |
| | Punch, Die, and Blank holder | | |
| | Punch side | 25 | 12 to 18 |
| | Die side | 25 | 12 to 22 |
| | Blank holder side | 25 | 10 to 12 |
| Comparative Example 3 | punch | 25 | 12 |
| | Die and Blank holder | | |
| | Die side | 25 | 12 |
| | Blank holder side | 25 | 12 |
| | Punch, Die and Blank holder | | |
| | Punch side | 25 | 12 |
| | Die side | 25 | 12 |
| | Blank holder side | 25 | 10 |

Actual maximum liquid pressure differs in each of the four liquid supply systems in Example 2. The difference is due to the local difference of contact pressure between the sheet 4 and the mold 1*b*, 2*b*, and 3*b* dependent on the shape of the product.

The reason why the maximum liquid pressure at the blank holder 3*b* was the lowest is that the contact pressure between the blank holder 3*b* and the sheet 4 is less.

The evaluation was given on the basis of the wrinkle, fracture, and flaw generated at corner under various levels of pressing-force applied to the blank holder.

In the case of Comparative Example 4, ordinary forming generated the wrinkle under a low blank holder pressing-force, and the increase in the pressing-force to avoid the generation of the wrinkle induced the generation of fracture and the occurrence of processing flaw at the drawing wall at corner portion. All of these defects resulted in defective products. That is, conventional forming method has no processing condition that avoids all of these defects at a time.

For the case that the liquid is supplied only from the punch, when the liquid supply is conducted by branching from a single system of liquid supply unit shown in Comparative Example 3, the products having no wrinkle nor fracture were obtained in a pressing-force range of from 40 to 90 kN.

In Example 2, press is performed in a wide range of blank holder pressing-force. The generation of the wrinkle and fracture was avoided in a range of from 40 to 110 kN of the pressing-force.

In the case that the liquid is supplied both from the die and the blank holder, Comparative Example 3 provided good products without generating the wrinkle and fracture at a blank holder pressing-force ranging from 20 to 40 kN.

Example 2 allowed to press in a wide range of blank holder pressing-force, and provided very good products without generating the wrinkle and fracture within a range of blank holder pressing-force from 20 to 60 kN.

In the case that the liquid is supplied from all the die, the blank holder, and the punch, Comparative Example 3 provided good products without generating the wrinkle and fracture by setting the blank holder pressing-force to a range from 20 to 100 kN.

Example 2 allowed to extend the blank holder pressing-force to a range of from 20 to 140 kN, and provided very good products without generating the wrinkle and fracture.

In FIG. 12, the referential numeral 8 on the punch 1*b* is a liquid supply groove. FIG. 12 is a preferred embodiment. The groove 8 supplies the liquid which is discharged from the liquid discharge opening 5 to a wide area. The groove is preferably selected responding to the shape of the formed product.

In FIG. 13, the referential numeral 35 denotes a lock bead placed on the die 2*b* which hinders the inflow of the edge of sheet 4 and prevents the generation of accretion and strain.

Example 3

Figure 15:
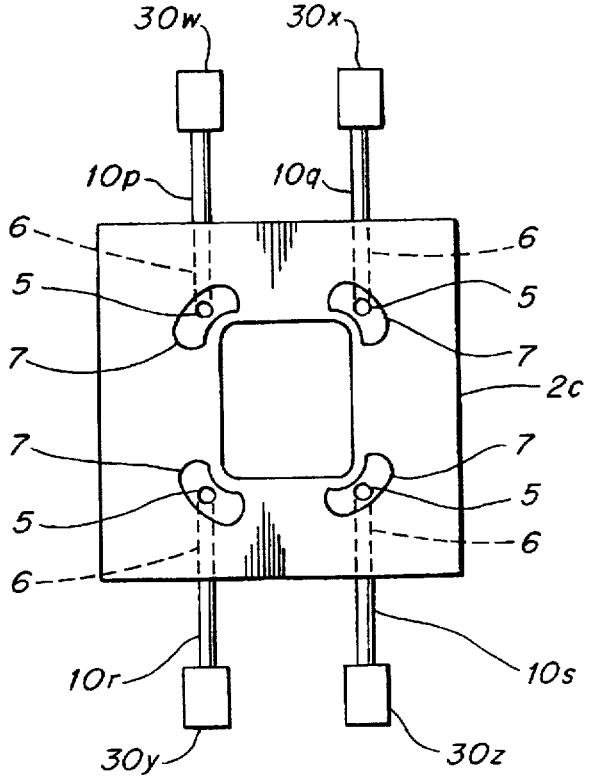
FIG. 15 is a plan view of the liquid supply unit provided with liquid pools on the die in forming the square tube of Example 3 of Embodiment 1.
Figure 17:
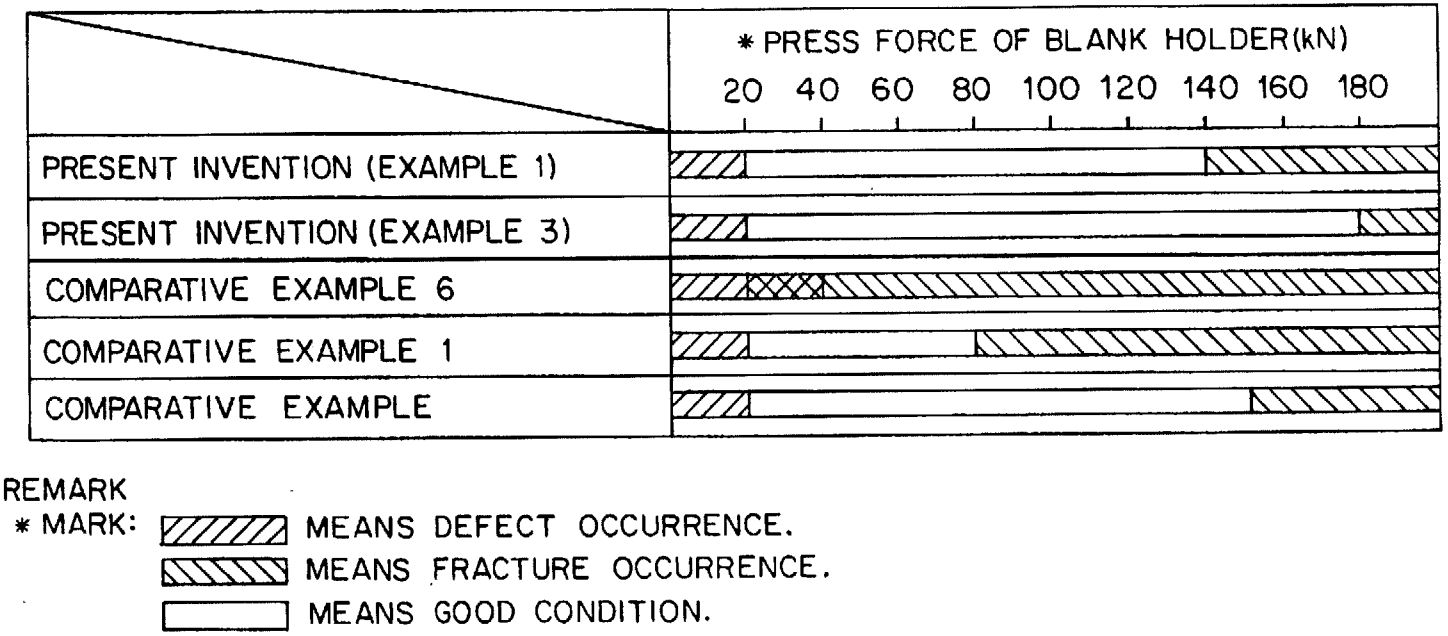
FIG. 17 shows the result of tests for forming the square tube of Example 3, Comparative Example 5 and Comparative Example 6 in Embodiment 1.

Example 3 gives the construction of an apparatus for forming a square tube with a bottom using mainly deep drawing under the presence of the liquid pools on the die, and gives the press-forming of the square tube with a bottom using the apparatus. FIGS. 15 is a view of the apparatus. Table 3 shows the condition of the liquid pressure. FIG. 17 shows the press condition and the result.

FIG. 15 is a plan view of the liquid supply unit provided with the liquid pools on the die. The liquid pools 7 are located at the periphery of the liquid discharge openings 5 on the die 2*c*. A single separated system of liquid supply path, liquid supply pipe, and liquid supply pump is allotted to every liquid discharge opening. The relative positioning of the liquid supply system with the liquid discharge opening 5 is arbitrary if only they are connected each other. Usually, however, the liquid discharge opening should be located within the area of the liquid pool 7.

Nevertheless, it is important for the area and depth of the liquid pool to form a closed curved surface between the mold, 2*c* and 3*c*, and the sheet 4, respectively, to prevent liquid from flowing out under a low pressure level and to ensure the hold of pressurized liquid at the maximum sheet-thickness portion.

The liquid pool is the technology to assure the presence of liquid throughout the forming process. It is more effective that the technology is applied simultaneously with the technology to supply the pressurized liquid responding to the contact pressure.

Following is basic concept of the liquid pool 7.

In case 1 of the sheet 4 being deep-drawn, the discharge opening 5 and the liquid pool 7 are arranged in a position corresponding to a possible-fracture zone at a flange of a product. The discharge opening 5 is arranged at least one of the die 2*c* and the blank holder 3*c*. The liquid pool 7 is arranged around the discharge opening 5. The liquid pool has a depth so that the possible-fracture-zone does not contact the die or the blank holder. The sheet 4 clamped between the die 2*c* and the blank holder 3*c* is drawn while applying a pressurized liquid to the sheet 4 through the liquid discharge opening 5.

In case 2 of the sheet 4 being deep-drawn, the discharge opening 5 and the liquid pool 7 are arranged in a position corresponding to a sheet-thickness increasing zone at a flange of a product. The discharge opening 5 is arranged at least one of the die 2c and the blank holder 3c. The liquid pool 7 is arranged around the discharge opening 5. The liquid pool has a depth so that the maximum sheet-thickness increasing zone does not contact the die or the blank holder. The sheet 4 clamped between the die 2c and the blank holder 3c is drawn while applying a pressurized liquid to the sheet 4 through the liquid discharge opening 5.

In case 3 of the sheet 4 being deep-drawn, the discharge opening 5 and the liquid pool 7 are arranged in a position corresponding to a sheet-thickness increasing zone at a flange of a product. The discharge opening 5 is arranged at least one of the die 2c and the blank holder 3c. The liquid pool 7 is arranged around the discharge opening 5. The liquid pool has a contour of constant-sheet-thickness line at near maximum sheet-thickness increasing zone and has a depth of {(maximum sheet thickness) minus (sheet thickness of constant-sheet-thickness curve zone)} or more. The sheet 4 clamped between the die 2c and the blank holder 3c is drawn while applying a pressurized liquid to the sheet 4 through the liquid discharge opening 5.

Figure 16:
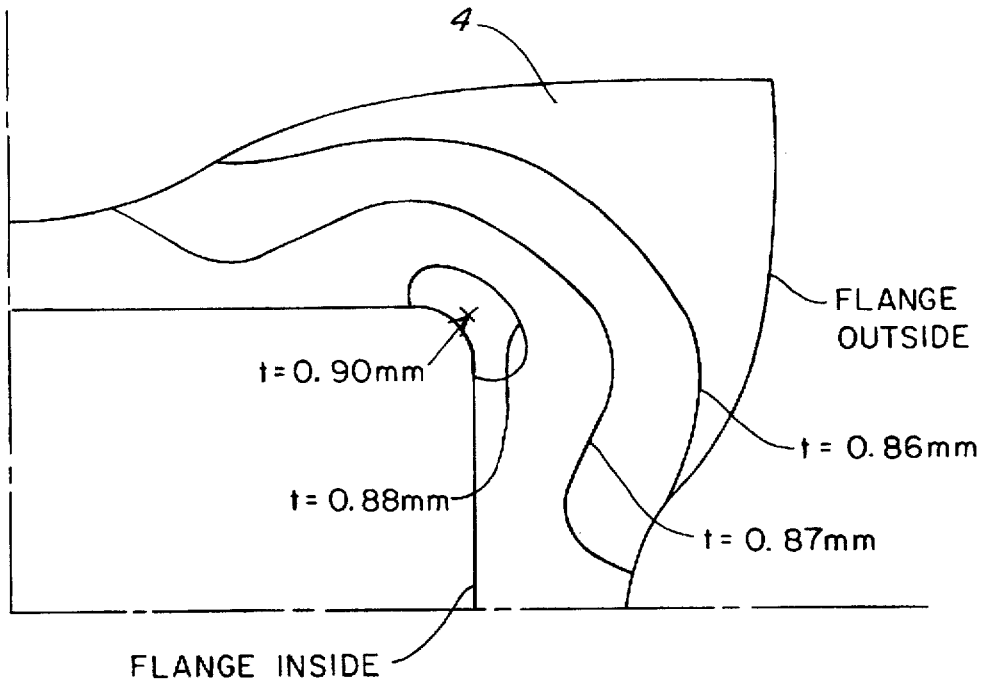
FIG. 16 is a graphic representation of a sheet-thickness distribution of the sheet formed at a portion clamped between the conventional die and the conventional blank holder.

FIG. 16 is an enlarged plan view of a formed shape showing the sheet-thickness distribution on the sheet being formed at a portion clamped between the die and the blank holder. The sheet is conventionally formed using the die or the blank holder. When a steel sheet (0.8 mm of thickness) coated by organic compound on the punch side and Zn-Ni plated on the die side is formed into a square tube with a bottom having 35 mm of height using a conventional mold without applying the liquid discharge opening 5 or the liquid supply path 6, the equi-sheet-thickness curve is drawn as 0.99 mm, 0.88 mm, 0.87 mm, and 0.86 mm of sheet-thickness.

There are two methods for fabricating the mold to have the finished pattern of sheet-thickness distribution on the flange portion of the formed product. One is to measure the sheet-thickness of the flange portion after draw-formed and to locate the liquid pool 7 at an adequate position by processing the die 2c or the blank holder 3c to fit the measured values. The other is to measure the constant-sheet-thickness distribution pattern at flange portion after draw-formed and to locate the liquid pool 7 which has a profile of the constant-sheet-thickness distribution pattern in the vicinity of the maximum sheet-thickness increase zone and has a depth of the difference of the maximum sheet-thickness and the sheet-thickness at constant-sheet-thickness line or deeper.

It is important that the liquid pool has a closed curved surface. If the supplied liquid does not enter the maximum sheet thickness portion but flows out from the peripheral area under a low pressure, then the effect of liquid supply considerably diminishes because the lubrication cannot be attained at the maximum sheet-thickness increasing zone which receives the most severe friction and the lubrication toward the die shoulder, R, along with the movement of sheet 4 under drawing (the flown-out liquid is supplied by make-up pressurized liquid).

The pressurized liquid may perform its effect by applying the liquid pool separately to the die 2c or the blank holder 3c. In further severe deep drawing, it is preferable to charge the pressurized liquid from both of the die and the blank holder.

In that case, the correction of increase in the sheet thickness may be allotted to the die 2c and the blank holder 3c. To equalize the pressing force of both the die 2c and the blank holder 3c needs a complex control system, so it is preferable to charge the pressurized liquid by locating the liquid pool 7 on the die 2c side and the liquid pool 7 on the blank holder 3c side at a position completely different.

When the liquid pool 7 is located at either one of the die 2c and the blank holder 3c, it is preferable to place the liquid pool 7 on the die 2c side where the friction with the sheet 4 is severer and to supply pressurized liquid directly from a discharge opening on the blank holder 3c side at the opposite place to the liquid pool 7 on the die 2c side via the sheet 4 without forming the liquid pool 7.

There are various methods to fabricate the liquid pool 7.

It is important to obtain constant-sheet-thickness curves at the flange portion of the formed square tube with a bottom having a height of 35 mm starting from a steel sheet (0.8 mm of thickness) coated by organic compound on the punch side and Zn-Ni plated on the die side using the conventional mold.

The depth of the liquid pool 7 may be determined to be three cases. The case 1 is that the sheet-thickness distribution is used to process the die 2c or the blank holder 3c, the case 2 is that the difference between the maximum sheet-thickness and the original sheet-thickness (0.8 mm) is taken as the maximum depth, and the case 3 is that the difference between the maximum sheet-thickness and the peripheral constant-sheet-thickness (0.88 mm) is taken as the maximum depth.

The profile (boundary) of the liquid pool 7 in the case 1 is a reversed shape with moderate profile. As for the case 2, the constant-sheet-thickness distribution curve is adopted or the sole sheet-thickness increasing boundary is adopted. The case of constant-sheet-thickness distribution curve may have a step at the boundary, and preferably the boundary is processed in a smooth transition to neighboring surface.

The case 3 is in the narrowest range and within a range of the maximum sheet-thickness and peripheral constant-sheet-thickness curve (0.88 mm). Usually, the case provides sufficient effect of the function of the present invention.

The fabrication of the mold, or the die 2c or blank holder 3c, before locating the liquid pool 7 may be performed using the apparatus shown in FIG. 18 by a test drawing of the sheet 4 applied with a highly lubricant oil or coated by polyethylene film and by correcting the mold based on the drawn shape followed by locating the liquid pool 7 after measuring the sheet-thickness distribution at the flange portion.

The tendency of thickness increase depends on the drawing conditions such as sheet 4, shape and dimensions for drawing, and drawing height. A mold such as the die 2c and the blank holder 3c of the present invention may be fabricated during the initial stage of the processing.

FIG. 17 shows the result of tests for forming square tube with a bottom. The result was obtained using the sheet of a zinc-nickel coated steel sheet coated on one side by organic film. The figure includes Example 3 (with the liquid pool), Comparative Example 5 (the liquid supplied from a single system of the liquid supply unit to plurality of discharge openings), and Comparative Example 6 (conventional forming).

The forming conditions such as the form height of square tube with a bottom are the same with those given in FIG. 16. Example 3 shows the result of forming a square tube with a bottom having 35 mm of form height using the liquid pool of the case 3 based on the result of FIG. 16 only on the die 2c side.

Comparative Example 5 is the forming result using an apparatus which supplies liquid branching from a single system of liquid supply unit to the four liquid discharge openings 5e, 5g, 5i, and 5k shown in FIG. 1 by locating liquid pools 7.

Comparative Example 6 is the result of conventional forming of square tube with a bottom using the apparatus shown in FIG. 18 applying rust-proof lubrication oil. Table 3 shows the relation between the set pressure of supply liquid and the maximum liquid pressure appeared during actual pressing process.

TABLE 3

| | Liquid supply | Set liquid pressure (Mpa) | Actual maximum liquid pressure |
|---|---|---|---|
| Example 2 | Die and Blank holder | | |
| | Die side | 25 | 10 to 20 |
| | Blank holder side | 25 | 8 to 10 |
| Example 3 | Die and Blank holder | | |
| | Die side | 25 | 15 to 25 |
| | Blank holder side | 25 | 8 to 10 |
| Comparative | Die and Blank holder | | |
| Example 1 | Die side | 25 | 10 |
| | Blank holder side | 25 | 8 |
| Comparative | Die and Blank holder | | |
| Example 5 | Die side | 25 | 15 |
| | Blank holder side | 25 | 10 |

The evaluation was given on the basis of wrinkle, fracture, and flaw generated at corner under various level of pressing-force applied to the blank holder.

In the case of Comparative Example 6, conventional forming generated the wrinkle under a low blank holder pressing-force, and the increase in the pressing-force for avoiding the generation of the wrinkle induced the generation of the fracture.

When water is applied from both the die and the blank holder sides, a favorable product free of the wrinkle and fracture is obtained in Comparative Example 5 by setting a pressure of blank holder to a rang of from 20 to 150 kN.

Example 3 allowed to extend the blank holder pressing-force to a range of from 20 to 180 kN using water, and provided very good products without generating the wrinkle and fracture.

The method of the present invention is applicable to a general-purpose press having no-special function without degrading its productivity. The step of oil-application to the sheet before the forming is eliminated. A suitable selection of liquid further eliminates the degreasing step after the forming. Thus the production efficiency and workability are significantly improved compared with prior art.

PREFERRED EMBODIMENT-2

Firstly, the embodiment-2 provides a method in which a discharge opening and a liquid pool are arranged in a position corresponding to a possible-fracture zone at a flange of a product. The discharge opening is arranged at least one of the die and the blank holder. The liquid pool is arranged around the discharge opening. The liquid pool has a depth so that the possible-fracture-zone does not contact the die or the blank holder. The sheet clamped between the die and the blank holder is drawn while applying a pressurized liquid to the sheet through the liquid discharge opening.

Secondly, the embodiment-2 provides a method in which a discharge opening and a liquid pool are arranged in a position corresponding to a sheet-thickness increasing zone at a flange of a product. The discharge opening is arranged at least one of the die and the blank holder. The liquid pool is arranged around the discharge opening. The liquid pool has a depth so that the maximum sheet-thickness increasing zone does not contact the die or the blank holder. The sheet clamped between the die and the blank holder is drawn while applying a pressurized liquid to the sheet through the liquid discharge opening.

Thirdly, the embodiment-2 provides a method in which a discharge opening and a liquid pool are arranged in a position corresponding to a sheet-thickness increasing zone at a flange of a product, and the liquid pool has a contour of constant-sheet-thickness line at near maximum sheet-thickness increasing zone and has a depth of {(maximum sheet thickness) minus (sheet thickness of constant-sheet-thickness curve zone)} or more. The discharge opening is arranged at least one of the die and the blank holder. The liquid pool is arranged around the discharge opening. The sheet clamped between the die and the blank holder is drawn while applying a pressurized liquid to the sheet through the liquid discharge opening.

Fourthly, the embodiment-2 provides an apparatus for drawing a sheet which comprises: a discharge opening arranged on at least one of a die and a blank holder; a liquid pool arranged on at least one of the die and the blank holder around the liquid discharge opening, wherein the liquid pool has a shape corresponding to a pattern of sheet-thickness distribution of a flange of a product; and a means for applying a pressurized liquid to the sheet clamped between the die and the blank holder through the liquid discharge opening.

And fifthly, the embodiment-2 provides an apparatus for drawing a sheet which comprises: a discharge opening arranged on at least one of a die and a blank holder; a liquid pool located on at least one of a die and a blank holder, around the liquid discharge opening corresponding to a sheet-thickness increasing zone of a flange of a product, wherein the liquid pool has a contour of constant-sheet-thickness distribution at near maximum sheet-thickness increasing zone and has a depth of at least the difference of maximum sheet thickness and sheet thickness at a constant-sheet-thickness curve; and a means for applying pressurized liquid to the sheet clamped between the die and the blank holder through the liquid discharge opening, which means is arranged on the die and/or the blank holder.

The deep drawing in accordance with the embodiment-2 allows the pressurized liquid to exist at the possible fracture zone throughout the forming process so that the friction between the sheet and the die or between the sheet and the blank holder is significantly reduced, which results in decreasing damage on the sheet surface and avoiding generation of fracture of the sheet.

Conventional drawing is conducted also under the presence of the liquid pool that fits the irregular increase pattern of sheet thickness at the flange, which irregularity occurs during the forming process. As a result, for drawing into any shape of formed product, the pressurized liquid exists between faces of the sheet and the die or of the sheet and the blank holder throughout the forming process, so the friction between the sheet and the die or between the sheet and the blank holder is significantly reduced, which results in decreasing damage on the sheet surface and avoiding generation of fracture of the sheet.

As for the suppression of wrinkle occurrence, the pressurized liquid is supplied from the liquid pool located on the die and/or the blank holder to the plate being drawn. Thus the charged liquid is sealed in position throughout the forming process in any shape of the drawing product.

Accordingly, the forming process proceeds while the sheet is attached to the die and/or the blank holder under a uniform face pressure.

With the above-described function, instability to induce origin of wrinkle occurrence is eliminated, and the substantial blank-holding force increases. As a result, the generation of wrinkle is markedly suppressed compared with the case that the sheet is simply clamped by a die and a blank holder.

There are two methods for preparing the flange portion of formed product which has a plate-thickness distribution pattern appeared after the completion of forming. One is to measure the sheet-thickness distribution on the flange portion after draw-formed and to locate the liquid pool at an adequate position by processing the die or the blank holder to fit the measured values. The other is to measure the equi-sheet-thickness distribution pattern at flange portion after draw-formed and to locate the liquid pool which has a profile of the equi-sheet-thickness distribution pattern in the vicinity of the maximum sheet-thickness increase zone and has a depth of the difference of the maximum sheet-thickness and the sheet-thickness at equi-sheet-thickness curve section or deeper depth.

It is important that the liquid pool has a closed curved surface. If the supplied liquid does not enter the maximum sheet thickness portion but flows out from the peripheral area under a low pressure, then the effect of liquid supply considerably diminishes because the lubrication cannot be attained at the maximum sheet-thickness increasing zone which receives the most severe friction and the lubrication toward the die shoulder, R, along with the sheet movement under drawing (the flown-out liquid is supplied by make-up pressurized liquid).

The pressurized liquid may perform its effective function by applying the embodiment-2 separately to the die and the blank holder. In further severe drawing, it is preferable to supply the pressurized liquid from both of the die and the blank holder.

In that case, the correction of increase in the sheet thickness may be allotted to the die and the blank holder. To equalize the pressing force of both the die and the blank holder needs a complex control system, so it is preferable to supply the pressurized liquid by locating the liquid pool on the die side and the liquid pool on the blank holder side at relatively different position.

When the liquid pool is located at either one of the die and the blank holder, it is preferable to place the liquid pool on the die side where the friction with the sheet being drawn is severer and to supply pressurized liquid directly from a discharge opening on the blank holder side at the opposite place to the liquid pool on the die side via the sheet without forming the liquid pool.

Higher pressure of applied liquid is preferred. Generally, clear effect appears at the pressure of 2 MPa or more for the prevention of wrinkle generation and of 5 MPa for the prevention of fracture occurrence.

The apparatus may have a means for adjusting the liquid pressure responding to the easiness of drawing and to the generating state of defects. The upper limit of the liquid pressure may be 50 MPa or less depending on the practical strength of the mold including die and blank holder, the liquid supply pipe, and liquid supply unit, or may be set at an arbitrary level using a relief valve to protect the apparatus.

The kind of liquid applied is not necessarily limited. Any kind of liquid is applicable if only it does not induce defects such as corrosion and plugging within the liquid supply route, and it does not induce corrosion of the sheet and does not degrade the degreasing property.

Figure 19:
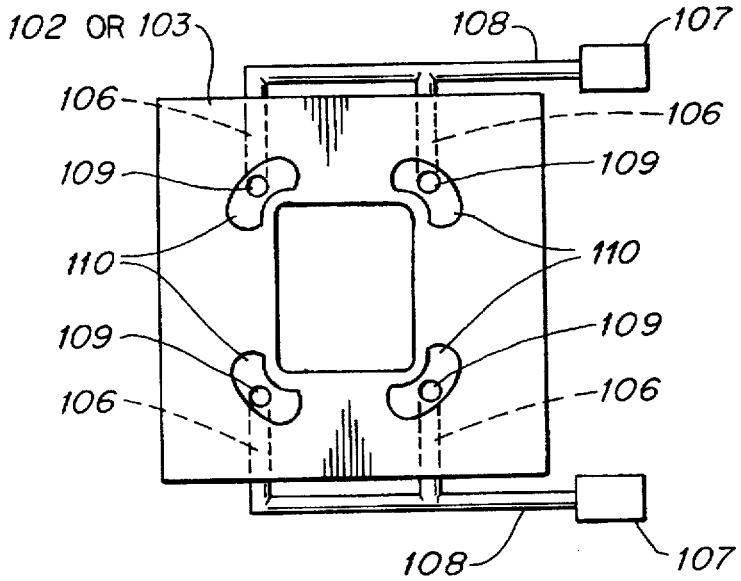
FIG. 19 is a plan view of the die or blank holder to form square tube in accordance with Embodiment-2.
Figure 20:
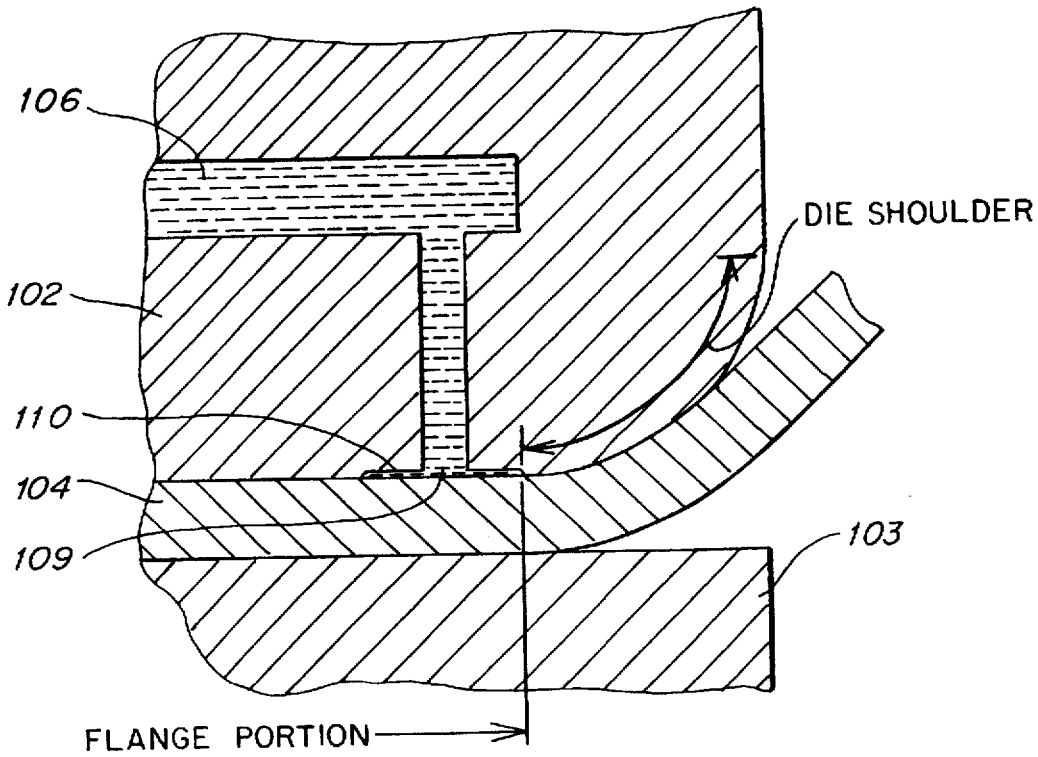
FIG. 20 is a cross sectional view of the die or blank holder to form square tube with a bottom in accordance with the Embodiment-2.

FIG. 19 shows the plan view of a square tube forming die of the embodiment-2 to form a square tube with a bottom. FIG. 20 shows a cross sectional view of a corner part of die of the embodiment-2 to form a square tube with a bottom.

Figure 28:
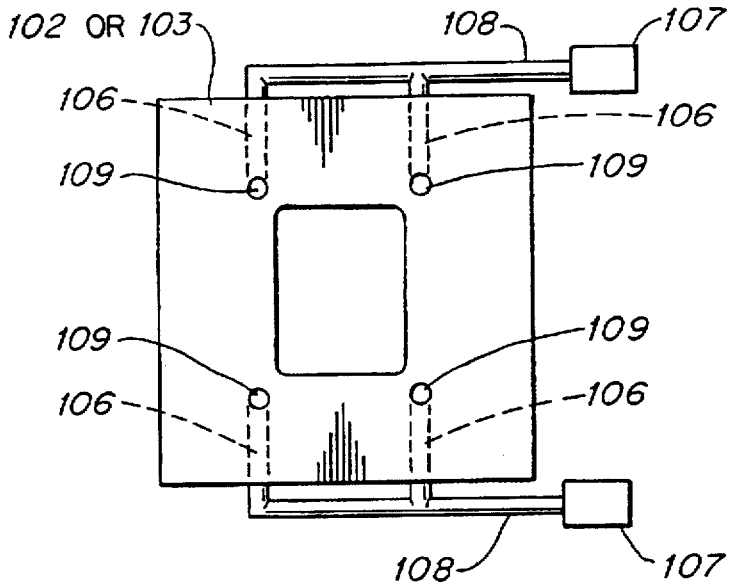
FIG. 28 is a plan view of a die or a blank holder showing the state of drawing under a condition of applying pressurized liquid to the sheet through the die or the blank holder in accordance with the Embodiment-2.
Figure 27:
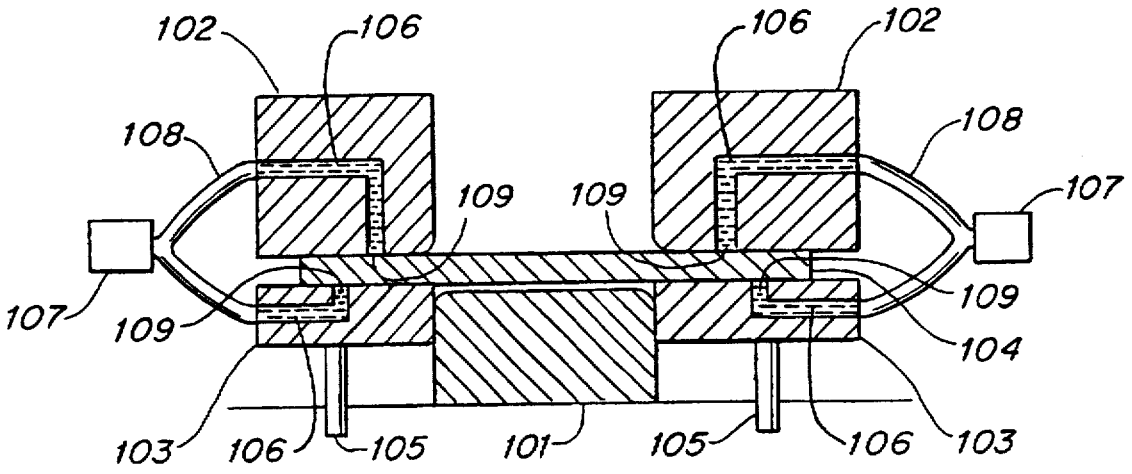
FIG. 27 is a cross sectional view showing the state of immediately before drawing under a condition of applying pressurized liquid to the sheet through a die or a blank holder in accordance with the Embodiment-2.

In FIGS. 19 and 20, the referential numeral 110 denotes liquid pool (the meaning of the same referential numeral with those in FIGS. 27 through 28 are not given here). The position of liquid discharge opening may be arbitrarily selected within the liquid pool 110.

Figure 25:
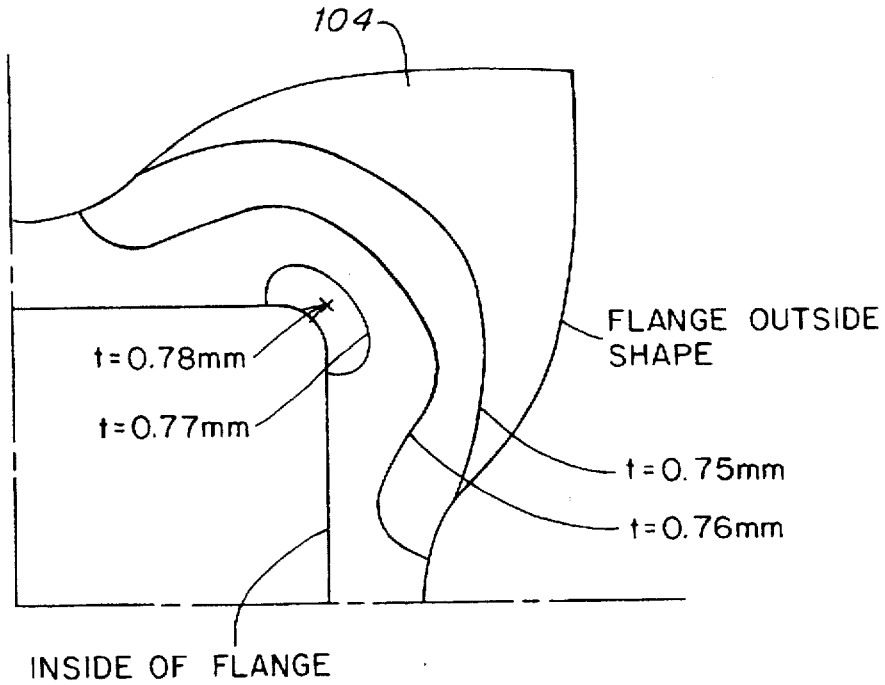
FIG. 25 is an example of sheet-thickness distribution on a plate portion of formed product clamped between the die and the blank holder using an ordinary die or blank holder.

There are several methods for fabrication of the liquid pool 110. FIG. 25 is an example of the liquid pool 110. Using a usual die and blank holder having no liquid discharge opening 109 nor liquid supply path 106 and having the same shape and dimensions (100 mm×100 mm of punch hole) with those of FIG. 19, a JIS SPCE cold-rolled steel sheet having 0.7 mm of thickness is formed into a square tube with a bottom having 40 mm of formed height. FIG. 25 is a quarter part-enlarged plan view of FIG. 19 showing the equi-sheet-thickness curves.

As shown in FIG. 25, the equi-sheet-thickness curves give contours of 0.78 mm, 0.77 mm, 0.76 mm, and 0.75 mm of thickness. At that time, existence of closed curved surface is required between the mold and the sheet to prevent the outflow of liquid under a low pressure and to assure the supply of liquid to the maximum sheet-thickness portion.

The depth of the liquid pool of the embodiment-2 may be determined in three cases. The case 1 is that the sheet-thickness distribution is used to prepare the die or the blank holder, the case 2 is that the difference between the maximum sheet-thickness and the original sheet-thickness (0.7 mm) is taken as the maximum depth. And the case 3 is that the difference between the maximum sheet-thickness and the peripheral equi-sheet-thickness (0.77 mm) is taken as the maximum depth.

The profile (boundary) of the liquid pool in the case 1 is a reversed shape with moderate profile. As for the case 2, the equi-sheet-thickness distribution curve is adopted or the sole sheet-thickness increasing boundary is adopted. The case of equi-sheet-thickness distribution curve may have a step at the boundary. The boundary, however is preferably processed in a smooth transition to neighboring surface.

The case 3 is in the narrowest range and within a range of the maximum sheet-thickness and peripheral equi-sheet-thickness curve (0.77 mm). Usually, the case provides sufficient effect of the function of the embodiment-2.

The fabrication of the mold, or the die or blank holder, before preparing the liquid pool may be performed by a test drawing of a sheet applied with a highly lubricant oil or coated by polyethylene film and by correcting the mold based on the drawn shape followed by locating the liquid pool after measuring the sheet-thickness distribution at the flange portion.

Figure 26:
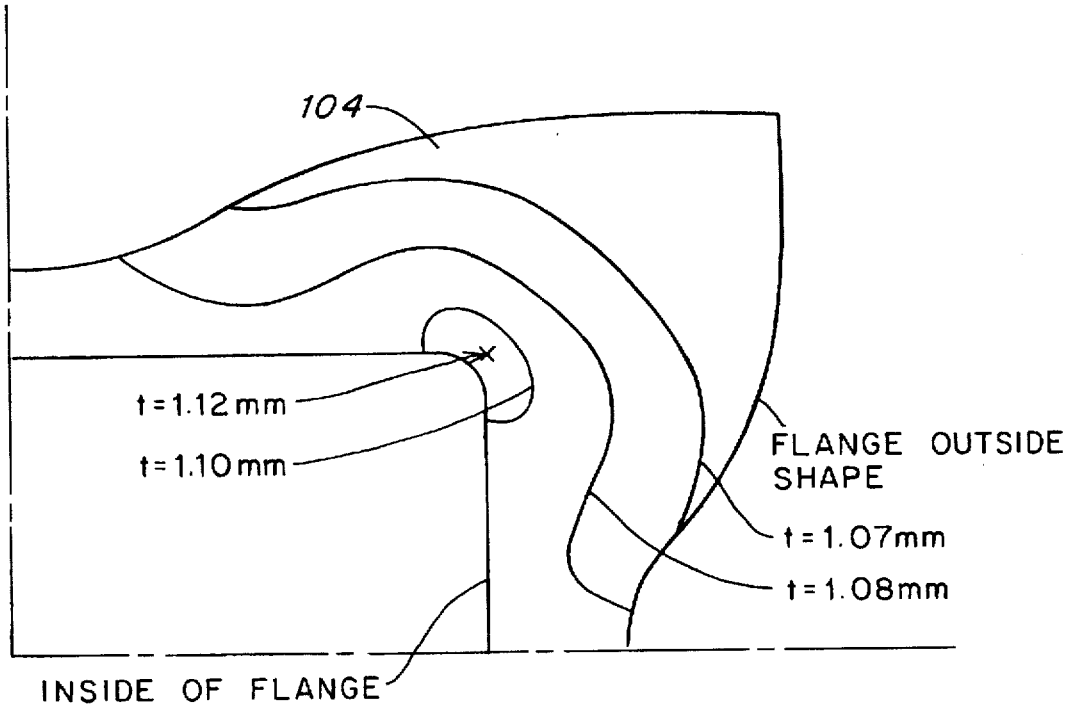
FIG. 26 is another example of plate-thickness distribution on a plate portion of a formed product clamped between the die and the blank holder using an ordinary die or blank holder.

In a similar manner with FIG. 25, FIG. 26 is a quarter part-enlarged plan view showing the equi-sheet-thickness curves of a flange portion of square tube with a bottom having 35 mm of formed height using a usual die having no liquid discharge opening 109 nor liquid supply path 106. The original sheet is a galvannealed sheet having 1.0 mm of thickness. The applied punch size is 100 mm×100 mm.

As shown in FIG. 26, the equi-sheet-thickness curves are those of 1.12 mm, 1.10 mm, 1.08 mm, 1.07 mm.

As described above, the tendency of thickness increase depends on the drawing conditions such as sheet, shape and dimensions for drawing, and drawing shape height. A mold such as the die and the blank holder of the embodiment-2 may be fabricated during the initial stage of the processing.

Figure 21:
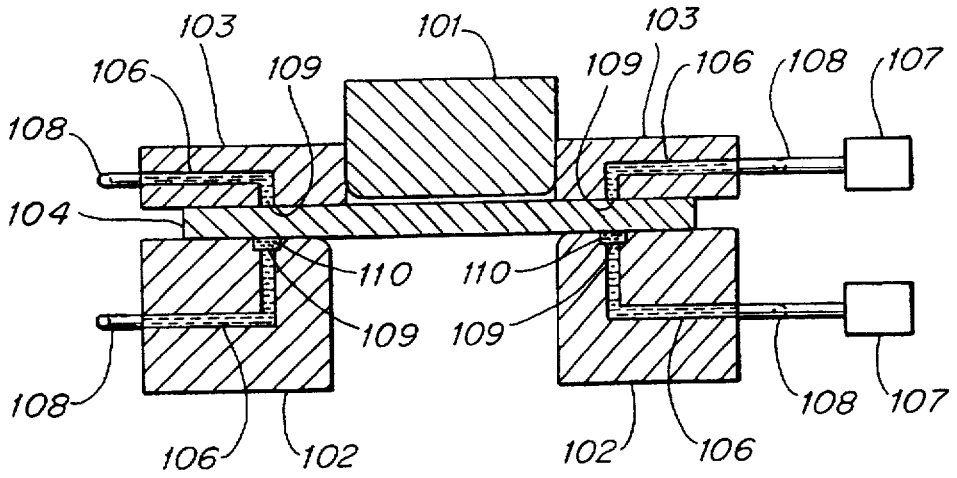
FIG. 21 is an example of cross sectional view showing deep drawing using a double-action press in accordance with the the Embodiment-2.
Figure 22:
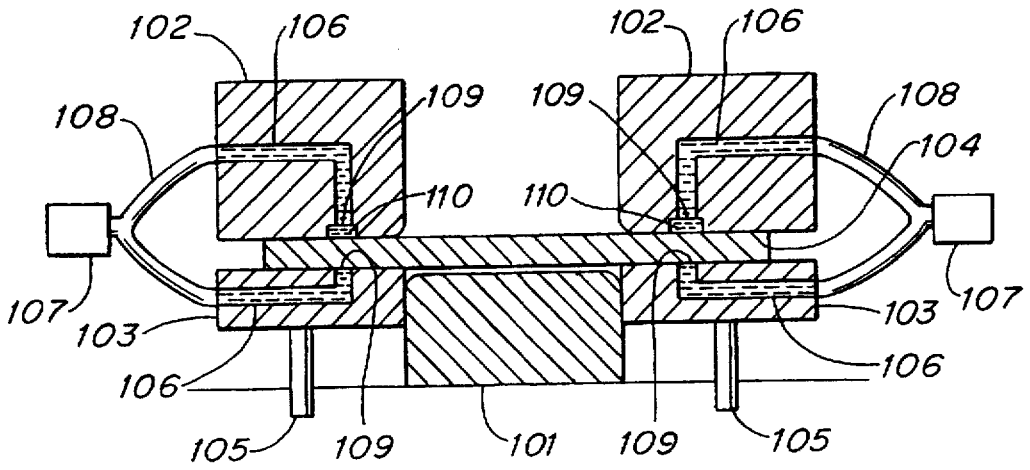
FIG. 22 is an example of cross sectional view showing deep drawing using a single-action press in accordance with the Embodiment-2.

FIG. 21 shows an example of double-action press apparatus which performs drawing in accordance with the case 3. FIG. 21 is a cross sectional view of the apparatus immediately before the drawing. FIG. 22 shows an example of single-action press apparatus which performs drawing in accordance with the case 3. FIG. 22 is a cross sectional view of the apparatus immediately before the drawing.

FIGS. 21 and 22 use the same reference numbers to FIGS. 27 through 28 for the same functioning parts, and no description of them is given here.

Regarding the drawing using those types of apparatus, or a drawing apparatus given in FIG. 21, or example, the sheet 104 is placed on the die 102, and the sheet 104 is clamped using the blank holder 103 under pressure, then the drawing is performed by descending the punch 101 while supplying the liquid which was pressurized by the liquid supply unit 107 into the liquid pool 110 which is located in a shape of equi-sheet-thickness distribution curves on the sheet 104 at the portion clamped between the die 102 and the blank holder 103 through the liquid discharge path 106 and the liquid discharge openings 109 which are located on the liquid supply pipe 108 and the die 102 or the blank holder 103.

By the procedure, a phenomenon of difficult-to-seal of the liquid is avoided, which phenomenon generates during the forming process owing to the thickness increase of sheet at a portion clamped between the die and the blank holder. Thus the suppression of the wrinkle generation and the avoidance of the fracture are achieved at a time. Thus a good processed product free of the wrinkle and fracture is easily produced.

The liquid supply unit 107 of the embodiment-2 may be any type if only it has a function to control the liquid pressure and the timing of liquid supply. The mechanism of the liquid supply unit 107 may be arbitrarily selected.

The timing for applying the high pressure liquid is basically immediately after the clamping of the sheet 104 between the die 102 and the blank holder 103. The pressure may be, however, applied before the clamping action or may be applied after the progress of forming process to some extent and just before the generation of wrinkle and fracture.

The description given above relates to an example of drawing using a double-action press shown in FIG. 21. The method of the embodiment-2 is applicable to a single-action press which is illustrated in FIG. 22 as an example. Either type of press is applicable if only it performs the drawing. Any type of the sheet to use in the embodiment-2 is applicable if only it is used for drawing.

Figure 23:
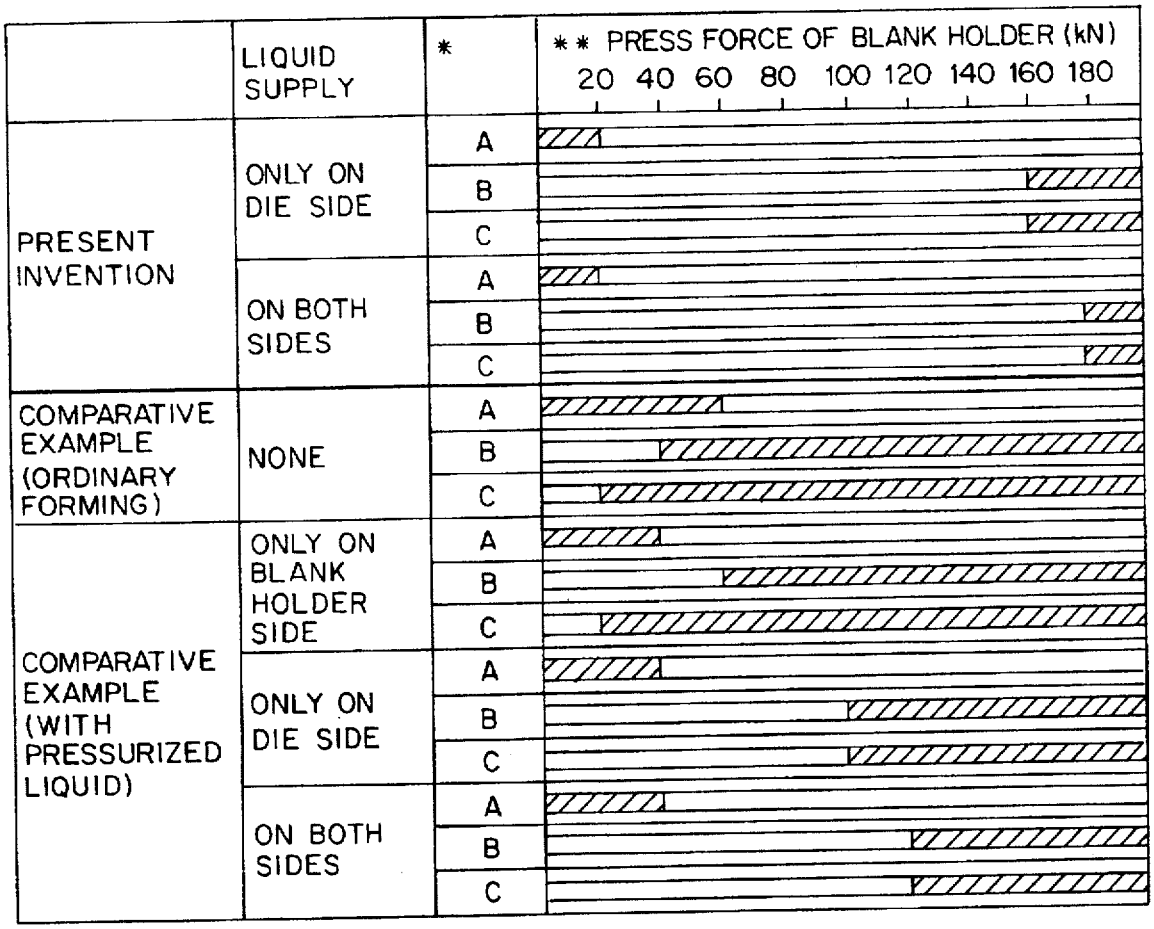
FIG. 23 is the test results of deep drawing SPCE plate in accordance with the Embodiment-2.

FIG. 23 shows a result of drawing test using a JIS SPCE cold-rolled steel sheet having 0.7 mm of thickness and size of 200 mm×200 mm into a square tube with a bottom having 40 mm of formed height and size of 100 mm×100 mm using a combination given in FIG. 19 and FIG. 21 while applying the liquid pool of the case 103 based on the result of FIG. 26. As a comparison, the form result under a condition of combination given in FIG. 27 and FIG. 28 without using liquid pool, and the form result of drawing into a conventional square tube with a bottom. The evaluation was given on the basis of the wrinkle, fracture, and flaw generated at corner under various level of pressing-force applied to the blank holder.

Conventional forming (with application of lubricant and rust-proof oil) of Comparative Example generated wrinkle under a low blank holder pressing-force, and the increase in the pressing-force for avoiding the generation of the wrinkle induced the generation of fracture and the occurrence of processing flaw at the drawing wall on the corner. All of these defects result in defective products. That is, conventional forming method has no processing condition that avoids all of these defects at a time.

As for the case of Comparative Example without using the liquid pool, the drawing under a set pressure of 25 MPa applying to the sheet clamped between the die and the blank holder while applying water of 10 MPa of maximum pressure to compensate the leak through gaps can avoid the generation of the wrinkle and fracture by setting the blank holding pressure to a range of from 40 to 60 kN if the water is supplied only from the blank holder side. However, the generation of processing flaws on the drawing wall at corner portion cannot be avoided, and no favorable product is obtained.

When the water is supplied only from the die side, a favorable product is obtained by applying the blank holding force ranging from 40 to 100 kN, and when the water is applied from both die and blank holder sides, a favorable product free of wrinkle, fracture, and processing flaw on the wall of drawing corner is obtained by setting the blank holder pressing force to a range of from 40 to 120 kN.

On the other hand, when the method of the embodiment-2 is applied and when the water is supplied only from the die side under a set pressure of 25 MPa and actual maximum pressure of 25 MPa, a favorable product free of wrinkle, fracture, and processing flaw on the wall of drawing corner is obtained by setting the blank holding pressure ranging from 20 and 160 kN.

When the water is applied from both die and blank holder sides, a favorable product free of wrinkle, fracture, and processing flaw on the wall of drawing corner is obtained by setting a set force of blank holder ranging from 20 to 80 kN.

The above-described Examples were conducted by placing the liquid pools of the embodiment-2 at the die side and by supplying the pressurized water directly from a discharge opening positioned opposite to the liquid pool on the die side via the sheet without providing the liquid pool on the blank holder side.

Figure 24:
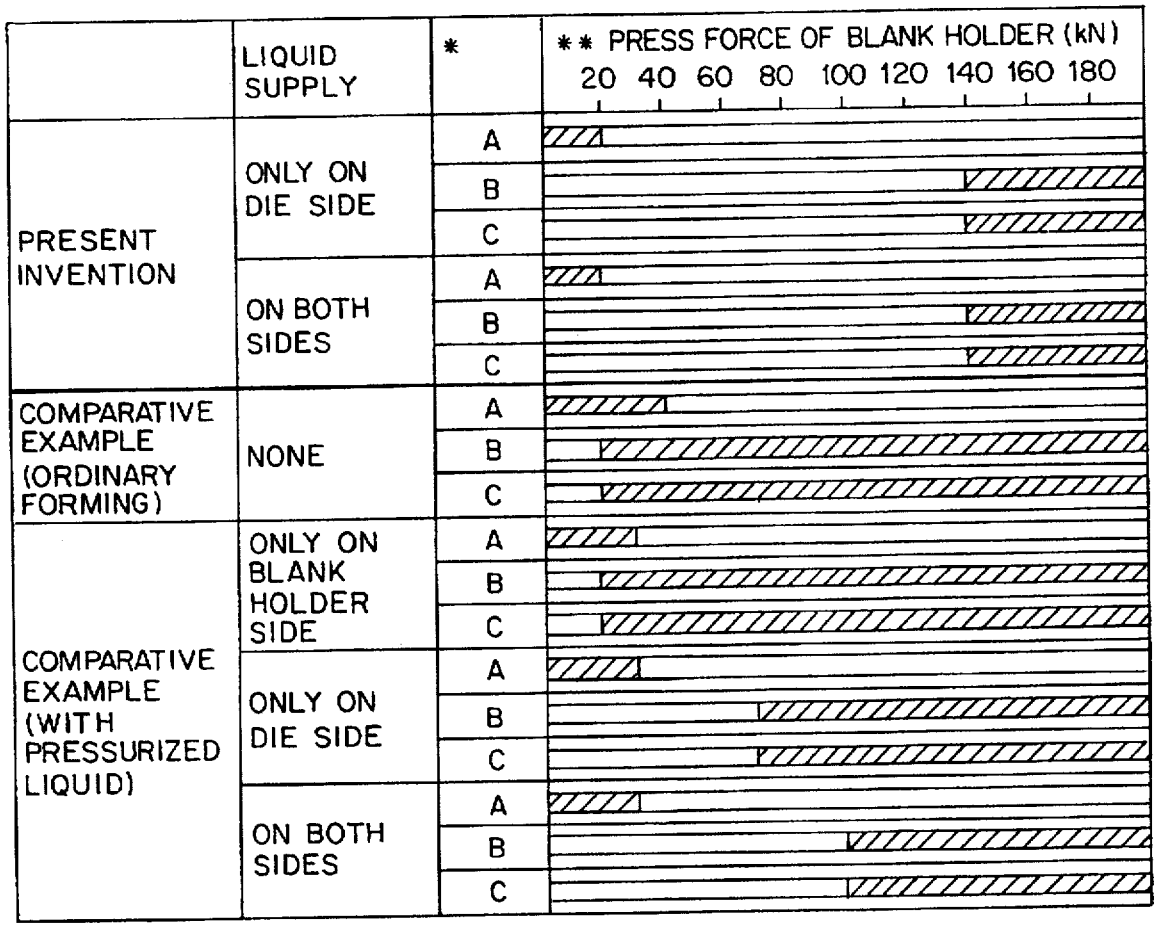
FIG. 24 is the test results of deep drawing alloyed hot-dip zinc steel sheet in accordance with the Embodiment-2.

FIG. 24 shows a result of drawing test using a galvannealed steel sheet having 1.0 mm of thickness and size of 170 mm×220 mm into a square tube with a bottom having 35 mm of formed height and size of 100 mm×150 mm while applying the liquid pool of the case 3 based on the result of FIG. 26. As a comparison, the form result of drawing a sheet clamped by a die and a blank holder while applying pressurized liquid without using a liquid pool, and a form result of ordinary drawing into an ordinary square tube with a bottom based.

The evaluation was given on the basis of the wrinkle, fracture, and flaw generated at corner under various levels of pressing-force applied to the blank holder.

Conventional forming (with application of lubricant and rust-proof oil) of Comparative Example generated the wrinkle under a low blank holder pressing-force, and the increase in the pressing-force for avoiding the generation of the wrinkle induced the generation of the fracture and the occurrence of processing flaw at the drawing wall on the corner. All of these defects result in defective products. That is, conventional forming method has no processing condition that avoids all of these defects at a time.

As for the case of Comparative Example without using the liquid pool, wherein the drawing is conducted under a set pressure of 25 MPa applying to the sheet being drawn clamped between the die and the blank holder while applying water of 8 MPa of maximum pressure to compensate the leak through gaps and wherein the water is applied only from the blank holder side, wrinkle occurs under a low pressing force of the blank holder. When the pressing force of the blank holder is increased to suppress the occurrence of wrinkle, fracture generates and flaws on the wall of drawing corner appear. Thus there is no favorable processing condition to obtain a good product.

When the water is supplied only from the die side, a favorable product is obtained by applying the blank holder pressing force ranging from 30 to 70 kN, and when the water is applied from both of the die and blank holder sides, a favorable product free of the wrinkle, fracture, and processing flaw on the wall of drawing corner is obtained by setting the blank holder pressing force to a range of from 30 to 100 kN.

On the other hand, when the method of the embodiment-2 is applied and when the water is supplied only from the die side under a set pressure of 25 MPa and actual maximum pressure of 25 MPa, a favorable product free of wrinkle, fracture, and processing flaw on the wall of drawing corner is obtained by setting the blank holder pressing force to a range of from 20 and 140 kN.

When the water is applied from both die and blank holder sides, a favorable product free of the wrinkle, fracture, and processing flaw on the wall of drawing corner is obtained by setting a set pressing force of blank holder to a range of from 20 to 140 kN.

The above-described Examples were conducted by placing the liquid pool of the embodiment-2 at the die side and by supplying the pressurized water directly from a discharge opening positioned opposite to the liquid pool on the die side via the plate being drawn without providing the liquid pool on the blank holder side.

According to the embodiment-2, the presence of high pressure liquid between the sheet and the die or between the sheet and the blank holder significantly reduces the generation of the flaws on the sheet such as a surface-treated steel sheet, a precoat plate, an aluminum alloy sheet, a tin sheet which are vulnerable to drawing.

The method of the embodiment-2 is applicable to general-purpose press apparatus having no-special function without degrading its productivity. The step of oil-application to the sheet before the forming is eliminated. A suitable selection of liquid further eliminates the degreasing step after the forming. Thus the production efficiency and workability are significantly improved compared with prior art.

What is claimed is:

1. A sheet press-forming method using a die and a punch, comprising the steps of:

a) holding a sheet between the die and a blank holder to form a first contact surface between the die and the sheet and a second contact surface between the sheet and the blank holder;

(b) forming a third contact surface between the punch and the sheet;

(c) supplying a pressurized liquid to the second contact surface between the sheet and the blank holder; and (d) pressing the sheet through the die with an aid of the punch.

2. The sheet press-forming method of claim 1, wherein the pressurized liquid has a pressure higher than a contact pressure existing between the sheet and the blank holder.

3. A sheet press-forming method using a die and a punch, comprising the steps of:

(a) holding a sheet between the die and a blank holder to form a first contact surface between the die and the sheet and a second contact surface between the sheet and the blank holder;

(b) forming a third contact surface between the punch and the sheet;

(c) supplying a pressurized liquid to the first contact surface between the die and the sheet; and also supplying the pressurized liquid to the second contact surface between the sheet and the blank holder; and (d) pressing the sheet through the die with an aid of the punch.

4. A sheet press-forming method using a die and a punch, comprising the steps of:

(a) holding a sheet between the die and a blank holder to form a first contact surface between the die and the sheet and a second contact surface between the sheet and the blank holder;

(b) forming a third contact surface between the punch and the sheet;

(c) supplying a pressurized liquid to the second contact surface between the die and the sheet; also supplying the pressurized liquid to the second contact surface between the sheet and the blank holder; and also supplying the pressurized liquid to the third contact surface between the sheet and the punch; and (d) pressing the sheet through the die with an aid of the punch.

5. A sheet press-forming method using a die and a punch, comprising the steps of:

(a) holding a sheet between the die and a blank holder to form a first contact surface between the die and the sheet and a second contact surface between the sheet and the blank holder;

(b) forming a third contact surface between the punch and the sheet;

(c) supplying a pressurized liquid to at least one contact surface selected from the group consisting of the first contact surface and the second contact surface and the third contact surface; and (d) pressing the sheet through the die with an aid of the punch;

wherein said step (c) of supplying the pressurized liquid comprises:

discharging the pressurized liquid from at least one opening which faces at least one contact surface, wherein said at least one opening is arranged at least in the blank holder; and introducing the pressurized liquid into at least one liquid pool which is arranged around at least one opening.

6. A sheet press-forming method using a die and a punch, comprising the steps of:

(a) holding a sheet between the die and a blank holder to form a first contact surface between the die and the sheet and a second contact surface between the sheet and the blank holder;

(b) forming a third contact surface between the punch and the sheet;

(c) supplying a pressurized liquid to at least one contact surface selected from the group consisting of the first contact surface and the second contact surface and the third contact surface; and (d) pressing the sheet through the die with an aid of the punch;

wherein said step (c) of supplying the pressurized liquid comprises:

discharging the pressurized liquid from at least one opening which faces at least one contact surface, wherein said at least one opening is arranged at least in the blank holder; and wherein said at least one opening is arranged at least in the punch; and introducing the pressurized liquid into at least one liquid pool which is arranged around at least one opening.

7. The sheet press-forming method of claim 5, wherein said at least one opening is arranged in the die and in the blank holder.

8. A sheet-forming method using a die and a punch, comprising the steps of:

(a) holding a sheet between the die and a blank holder to form a first contact surface between the die and the sheet and a second contact surface between the sheet and the blank holder;

(b) forming a third contact surface between the punch and the sheet;

(c) supplying a pressurized liquid to at least one contact surface selected from the group consisting of the first contact surface and the second contact surface and the third contact surface; and (d) pressing the sheet through the die with an aid of the punch, wherein said step (c) of supplying the pressurized liquid comprises:

discharging the pressurized liquid from at least one opening which faces at least one contact surface; and introducing the pressurized liquid into at least one liquid pool which is arranged around at least one opening;

wherein:

the at least one liquid pool is arranged around the opening in the blank holder;

the at least one liquid pool is arranged in a position corresponding to a possible-fracture-zone at a flange of a product; and the at least one liquid pool has a depth such that the possible-fracture-zone does not contact the blank holder.

9. The sheet press-forming method of claim 8, wherein:

the at least one liquid pool is arranged around openings in both the die and the blank holder; and the at least one liquid pool has a depth such that the possible-fracture-zone does not contact the die and the blank holder.

10. A sheet pressing-forming method using a die and a punch, comprising the steps of:

(a) holding a sheet between the die and a blank holder to form a first contact surface between the die and the sheet and a second contact surface between the sheet and the blank holder;

(b) forming a third contact surface between the punch and the sheet;

(c) supplying a pressurized liquid to at least one contact surface selected from the group consisting of the first contact surface and the second contact surface and the third contact surface; and (d) pressing the sheet through the die with an aid of the punch, wherein said step (c) of supplying the pressurized liquid comprises:

discharging the pressurized liquid from at least one opening which faces at least one contact surface; and introducing the pressurized liquid into at least one liquid pool which is arranged around at least one opening;

wherein:

the at least one liquid pool is arranged around the opening in the blank holder;

the at least one liquid pool is arranged in a position corresponding to a sheet-thickness increasing-zone at a flange of a product; and the at least one liquid pool having a depth such that the sheet-thickness-increasing-zone does not contact the blank holder.

11. The sheet press-forming method of claim 10, wherein the at least one liquid pool is arranged around the openings in both the die and the blank holder; and the at least one liquid pool has a depth such that the sheet-thickness increasing-zone does not contact the die and the blank holder.

12. The sheet press-forming method of claim 10, wherein;

the liquid pool has a contour of a constant-sheet-thickness lines and has a depth of at least the maximum sheet thickness minus the sheet thickness of a constant thickness curve zone.

13. The sheet press-forming method of claim 12, wherein:

the at least one liquid pool is arranged around openings in both the die and the blank holder.

14. A sheet press-forming apparatus comprising:

(a) a press unit for pressing a sheet, the press unit comprising a die and a punch;

(b) a blank holder for holding the sheet;

(c) liquid supply unit for supplying a pressurized liquid into at least one contact surface selected from the group consisting of a first contact surface between the die and the sheet, a second contact surface between the sheet and the blank holder, and a third contact surface between the punch and the sheet wherein the liquid supply unit comprises:

a pressure device for pressurizing a liquid into the pressurized liquid;

a liquid supply path for introducing the pressurized liquid into the second contact surface and an opening of the liquid supply path, the liquid supply path being arranged in the blank holder and the opening facing the second contact surface; and a liquid pool which is arranged around the opening.

15. The sheet press-forming apparatus of claim 14, wherein liquid pool has a shape which corresponds to a contour of a sheet thickness at a flange of a product.

16. The sheet press-forming apparatus of claim 14, wherein:

the liquid pool is arranged in a position corresponding to a sheet-thickness-increasing-zone at a flange of a product; and the liquid pool has a contour of a constant-sheet-thickness line, and has a depth of at least the maximum sheet thickness minus the sheet thickness of a constant thickness curve zone.

17. The sheet press-forming apparatus of claim 14, wherein:

the liquid pool is arranged in a position corresponding to a sheet-thickness-increasing-zone at a flange of a product; and the liquid pool has a depth so that the sheet-thickness-increasing-zone does not contact the blank holder.

18. The sheet press-forming apparatus of claim 14, wherein said liquid supply unit further comprises:

a liquid supply path for introducing the pressurized liquid into the first contact surface and an opening of the liquid supply path, the liquid supply path and the opening being arranged in the die and the opening facing the first contact surface;

a first liquid pool which is arranged around the opening of the die; and a second liquid pool which is arranged around the opening of the blank holder.

19. The sheet press-forming apparatus of claim 18, wherein said first and second liquid pools have a shape which corresponds to a contour of sheet thickness at a flange of a product.

20. The sheet press-forming apparatus of claim 18, wherein:

the first and second liquid pools are arranged in a position corresponding to a sheet-thickness-increasing-zone at a flange of a product;

the first and second liquid pools have a contour of a constant sheet-thickness line, and has a depth of at least the maximum sheet thickness minus the sheet thickness of a constant thickness curve zone)} or more.

21. The sheet press-forming method of claim 18, wherein:

the first and second liquid pools are arranged in a position corresponding to a possible-fracture-zone at a flange of a product.

* * * * *